US005464975A

United States Patent [19]

Kirchner et al.

[11] Patent Number: 5,464,975

[45] Date of Patent: Nov. 7, 1995

[54] METHOD AND APPARATUS FOR CHARGED PARTICLE COLLECTION, CONVERSION, FRAGMENTATION OR DETECTION

[76] Inventors: Nicholas J. Kirchner, 250 Del Medio Ave., Ste. 201, Mountain View, Calif. 94040; Michael Weber-Grafau, 808 Pear Ave., Sunnyvale, Calif. 94087

[21] Appl. No.: 167,716

[22] Filed: Dec. 14, 1993

[51] Int. Cl.[6] ..... H01J 49/26

[52] U.S. Cl. ..... 250/283; 250/292; 250/281; 250/282

[58] Field of Search ..... 250/283, 282, 250/292, 281

[56] References Cited

U.S. PATENT DOCUMENTS

| | | | |
|---|---|---|---|
| Re. 33,344 | 9/1990 | Stafford | 250/281 |
| 2,939,952 | 6/1960 | Paul et al. | 250/41.9 |
| 3,410,997 | 11/1968 | Brubaker | 250/292 |
| 3,774,028 | 11/1973 | Daly | 250/41.9 |
| 4,047,030 | 9/1977 | Lobach | 250/281 |
| 4,227,087 | 10/1980 | Kurz | 250/281 |
| 4,423,324 | 12/1983 | Stafford | 250/281 |
| 5,026,987 | 6/1991 | Bier et al. | 250/281 |
| 5,206,506 | 4/1993 | Kirchner | 250/281 |

OTHER PUBLICATIONS

Aberth, "Use of a Microchannel Plate for Surface Induced Dissociation (McSID)," *Proceedings of the 36th ASMS Conference on Mass Spectrometry and Allied Topics,* Jun. 5–10, pp. 73–74 (1988).

Beuhler et al., "Low Noise, High Voltage Secondary Emission Ion Detector for Polyatomic Ions," *Int. J. Mass Spectrom. Ion Phys.,* 23:81–97 (1977).

Davis et al., "Computer modelling of fragmentation processes in radio frequency multipole collision cells," *Rapid Comm. in Mass Spectrometry* 4(6):186–197 (1990).

*Quadrupole Mass Spectrometry and Its Applications* (ed. Peter H. Dawson, Elsevier, Amsterdam, 1976), p. 10.

Donnelly et al., "Detection of metastable atoms and molecules with continuous channel electron multipliers," *Rev. Sci. Instr.,* p. 1242 (1969).

Holme, A. E. "Operation of a Quadrupole Mass filter with Only and R. F. Voltage Component Applied to the Rod System," *Int. J. Mass Spectrom. and Ion Physics,* 22:1–5 (1976).

Holme et al., "A Detailed Study of the Quadrupole Mass Filter Operating with No D.C. Component on the Rods," *Int. J. Mass Spectrom. and Ion Physics,* 26:191–204 (1978).

Hu et al., "Inductively coupled plasma mass spectrometry with an enlarged sampling orifice and offset ion lens. I. Ion trajectories and detector performance," *J. Am. Soc. Mass Spectrom.* 4:16–27 (1993).

Hunter et al., "An improved model of the fringing fields of a quadrupole mass filter," *International Journal of Mass Spectrometry and Ion Processes* 87:157–164 (1989).

Reagan et al., "Mass–dependent effects of channel electron multipliers in residual gas analyzers," *J. Vac. Sci. Technol. A.* 5(4):2389–2392 (1987).

Schoen et al., "Improvement in high mass ion detection of a tandem quandrupole mass spectrometer using a high voltage post–acceleration detector," 36th *ASMS Conference*

(List continued on next page.)

*Primary Examiner*—Jack I. Berman

*Attorney, Agent, or Firm*—Townsend and Townsend Khourie and Crew

[57] ABSTRACT

An apparatus and method for providing mass-selected particles. A mass filter adapted to receive a flux of particles at its entry emits a mass-selected subset of the received flux of particles at its exit, and an electrode configuration provides electric fields for deflecting at least some of the mass-selected subset of particles thus emitted across a substantially open spatial region through substantially 180 degrees of arc. The deflected particles can be collected, converted, fragmented, or detected. The apparatus and method are suitable for use with a multipole (e.g., quadrupole) mass filter, and the electrode configuration can easily be retrofitted to existing installed multipole mass spectrometers as well as adapted to newly manufactured designs.

47 Claims, 16 Drawing Sheets

OTHER PUBLICATIONS on Mass Spectrometry and Allied Topics (pp. 843–844), Jun. 5–10, San Francisco (1988).

Syka et al., "Characteristics of linear and non–linear R. F.–only quadrupole collision cells," *International Journal of Mass Spectrometry and Ion Processes* 96:97–109 (1990).

Tobita et al., "Absolute detection efficiency of a microchannel–plate detector for ions and neutrals," *Japanese Journal of Applied Physics* 26(3):509–510 (1987).

Todd et al., "Quadrupole mass spectrometry," in Mass Spectrometry (A. Maccoll ed., Butterworth & Co. (Publishers) Ltd., Reading, Mass., pp. 289–348 (1975).

Weaver et al., "Modulation techniques applied to quadrupole mass spectrometry," in Dynamic Mass Spectrometry vol. 5 (D. Price et al., ed., Hayden Publishers, Philadelphia, Pa., pp. 41–55 (1978).

Weiss, "Quadrupole detection system with high dynamic range amplifier," *Advances in Mass Spectrometry,* 8:1624 (1980).

METHOD AND APPARATUS FOR CHARGED PARTICLE COLLECTION, CONVERSION, FRAGMENTATION OR DETECTION

INCORPORATION BY REFERENCE

The disclosures in this application of all articles and references, including patent documents, are incorporated herein by reference.

BACKGROUND OF THE INVENTION

The present invention relates generally to the field of high-frequency multipole mass spectrometry and more particularly to the field of deflecting and collecting mass-filtered charged particles at the exit of a quadrupole mass filter for the purposes of detection or conversion to other charged species.

A Brief History of Multipole Mass Spectrometry

Since their development in the 1950s, multipole and in particular quadrupole mass spectrometers have gained considerable scientific and commercial importance in many diverse fields ranging from chemical analysis to the establishment of highly precise atomic time standards. Wolfgang Paul, co-inventor on U.S. Pat. No. 2,939,952 entitled "Apparatus for Separating Charged Particles of Different Specific Charges" (hereinafter, the '952 patent), shared the 1989 Nobel prize in Physics with H. Dehmelt for his contributions in the development of these devices. Dr. Paul's achievement reflects the significance and impact of quadrupole mass spectrometry. Many of the basic electrode configurations and anticipated uses for quadrupole mass filters are as shown or predicted in the '952 patent. Today, most of the analytical mass spectrometers in use today are of the quadrupole type, with several tens of thousands of these instruments in daily use worldwide. The proliferation and wide acceptance of quadrupole mass spectrometers can be attributed to their simplicity, reliability, and low cost compared to other types of mass spectrometers.

A typical quadrupole mass spectrometer system consists of the following components (see FIG. 1, which is described more fully below): a sample inlet; an ion source to convert the sample into charged species of certain mass-to-charge (m/z) ratios; a quadrupole mass filter (also called a quadrupole mass analyzer) that preferentially passes one m/z ratio at a time; and a detector to detect the abundance of the transmitted charged particles. By scanning the RF and DC voltages applied to the quadrupole mass filter, a mass spectrum such as the one shown in FIG. 2A can be generated, showing signal intensity (in arbitrary units) versus the m/z ratio (in dalton units.) The mass spectrum is a "fingerprint" pattern useful for identification and quantification of the sample. In many applications, the signal at high m/z values is of the greatest interest; unfortunately, the production of ions of high m/z value is difficult and existing methods and devices for the detection of high-mass ions in quadrupole mass spectrometers are not very efficient.

The number of applications for quadrupole mass spectrometers continues to increase. Quadrupole mass spectrometers are used in the analysis of the environment for contaminants, testing for drugs of abuse, medical testing and the development of new pharmaceuticals, energy research and biochemical analysis, just to name a few. Some quadrupole mass spectrometers are complex and relatively expensive research-grade instruments for biomedical and biochemical applications such as deducing the structure of proteins or the sequencing of DNA. On the opposite end of the spectrum, small, simple and inexpensive quadrupole mass spectrometers are used as routine detectors for gas chromatography. Other types of mass quadrupole mass spectrometers are used by government agencies, for example in backpack portable instruments for in-situ analysis of hazardous chemicals in the environment, in mobile battlefield laboratories to warn of impending chemical or biological attack, or in enormous machines for the separation of atomic isotopes.

The ever-broadening range of applications of quadrupole mass spectrometers places ever-increasing demands on the performance of these devices. Unfortunately, existing technology and commercial instruments are not always up to the task. New applications often require more specific, reliable mass analysis and more sensitive detection, in particular of ions with large mass-to-charge ratios, than present instruments can provide. Yet the large installed base of quadrupole mass spectrometers represents a considerable investment in capital and expertise, an investment that cannot readily be abandoned. Thus there is a desire to upgrade and improve the capabilities of existing instruments to meet the new demands.

Components of a Prior Art Quadrupole Mass Spectrometer System

A schematic representation of a typical quadrupole mass spectrometer in the prior art is shown in FIG. 1A. The system consists of a sample inlet 1, an ion source 2, a quadrupole mass filter 3 and a detector 4. The ion source, mass filter and detector are placed in an evacuated housing 5. Power supply electronics 6 provide all the necessary voltages to operate the mass spectrometer system. An amplifier and analog-to-digital converter 7 registers the detector signal, which is read into control computer 8 for processing and display to the user. Computer 8 also provides control signals for the power supply electronics.

Sample inlet 1 (for example, a gas chromatograph and suitable interface) serves to introduce the sample into ion source 2. In ion source 2, one or more charged ion species of certain m/z ratios are produced from the neutral sample molecules, for example by bombardment with electrons. A more or less focussed beam of charged particles exits ion source 2 and enters quadrupole mass filter 3.

In quadrupole mass filter 3 there exists a set of conditions to create an electric field that selectively passes charged particles of a certain mass-to-charge ratio or range of m/z ratios. The charged particles associated with this set of conditions are referred to as "mass-selected". In accordance with the method described in the '952 patent, a combination of a radio frequency (RF) and direct current (DC) voltage (FIG. 1B) results in the stable transmission of only ions of a particular m/z ratio through the quadrupole mass filter 3. All other particles transmitted through the device at the same time but not intended to be stable under the given set of conditions are referred to as "non-mass-selected".

Detector 4 provides a measurement of the flux of mass-filtered ions of the selected m/z ratio exiting from the quadrupole mass filter. A mass spectrum is generated by scanning the RF and DC voltages and measuring the transmitted ion current at each setting.

In addition to these components, all quadrupole mass spectrometers contain transfer and focusing elements between the major components, such as electrostatic lenses of various designs and RF-only multipole sections. In virtually all quadrupole mass spectrometer designs presently available, the major components are arranged in series along a linear ion-optical axis which is substantially a straight line, as schematically indicated in FIG. 1A.

In multi-stage quadrupole mass spectrometers, a fragmentation stage is provided in which charged particles transmitted through the first mass filter are fragmented upon one or more collisions with a neutral gas, a solid surface, electrons or photons. In a so-called triple quadrupole mass spectrometer as disclosed in U.S. Pat. No. 4,234,791, the collision stage is an RF-only quadrupole cell, followed by a second quadrupole mass filter to analyze the fragment charged particles. U.S. Pat. No. 5,026,987 discloses a multi-stage quadrupole mass spectrometer with an in-line collision surface.

Flaws of Prior Art Detectors for Quadrupole Mass Spectrometers

In all designs of detectors for a quadrupole mass spectrometer, the key objectives are high collection efficiency and low noise. However, certain kinds of flaws are inherent in the designs and operations of these units as a class, that is, they are common to all quadrupole mass spectrometers both new and old. Often, newer applications requiring mass analysis are susceptible to more than one of these shortcomings. The key problems are (a) lack of high-mass sensitivity (also referred to as high-mass discrimination), and (b) noise from particles that are not mass-selected.

High-mass Discrimination

In the prior art, it is generally observed that quadrupole mass spectrometers show a marked decrease in sensitivity with increasing mass. The experimental observations contradict what is predicted by theory [*Todd75]. The effect of mass discrimination exhibited by the quadrupole mass filter can be seen in the comparison with a compendium of mass spectral data. Standard data bases built up over a number of years based on magnetic sector type mass spectrometers typically exhibit higher relative abundance of high mass ions in comparison with the mass spectrum obtained from the same compound using quadrupole mass spectrometer instruments. For example, given an initial ion beam populated with masses over a wide mass range (FIG. 2A), the relative abundance of the detected mass-selected ions after passing through the quadrupole mass filter typically exhibits a precipitous drop with increasing mass (FIG. 2B), compared to their true abundance in the ion source.

Particle Noise

Current and emerging ionization methods generate a substantial amount of non-mass-selected particle noise [*Syka90], in particular, certain newly developed ionization techniques seeking effective ways for quadrupole mass analyses of very high molecular weight species.

Previous Attempts to Improve Detector Signal-to-Noise Ratios at High Mass

The two common problems of mass discrimination and non-mass-selected particle noise conspire together innumerator and denominator to seriously interfere with the signal-to-noise ratio at high mass. Many designs have been developed with the intention of overcoming one or more of these problems, and the sheer number of these works demonstrates the need for improvement.

One line of research has involved attempts at improving the efficiency of transfer of ions from the source into the quadrupole mass filter. U.S. Pat. Nos. 3,235,724 and 3,129,327 attempt to furnish improved methods and devices to control ion transfer from the source through the fringing fields at the quadrupole entrance. However, efficient ion injection is accomplished quite easily and, therefore, these techniques have not offered sufficient performance improvement to warrant their incorporation into commercial instruments.

Other research has involved attempts at improving the performance of detection devices and reducing particle noise. Some of the results of this research will be described shortly. First, however, some additional background is in order.

Properties of Quadrupole Mass Spectrometer Systems

Previous attempts to overcome high-mass signal-to-noise ratio problems have been, on the whole, unsatisfactory. To understand why, certain properties of quadrupole mass spectrometer systems must be understood, properties that the prior art fails to take into account.

In the prior art, mass spectrometer detection devices have been designed based on the assumption that ions exit from the mass filter in a relatively well-defined, axial beam. The ion beam exiting from a magnetic sector instrument (a different kind of mass spectrometer that does not use a multipole filter) is, indeed, well defined spatially and characterized by a narrow energy spread. However, in the case of the quadrupole mass filter, we have found using sophisticated computer modeling of ion trajectories that the mass-selected ions exiting from the mass filter are widely dispersed spatially and have a substantial energy spread, compared to the conditions of their initial injection into the quadrupole. Moreover, we have found that the arrangements of electrostatic lenses, apertures and high-voltage conversion dynodes in accordance with the prior art results in field penetration into the mass filter with the effect of deflecting ions away from a path that would allow them to be detected or collected for further analysis.

The conditions governing real (as opposed to ideal) quadrupole mass filters are depicted in FIGS. 3A–3C. FIGS. 3A–3C schematically represent side and end views of the spatial region in which charged particles exiting from the source are collected by a suitable lens (or lenses) and injected into the quadrupole mass filter (the entrance region, shown in FIG. 3A); the quadrupole mass filter itself (the quadrupole region, shown in FIG. 3B); and the spatial region in which charged particles exit the quadrupole (the exit region, shown in FIG. 3C). In the entrance region and in the exit region (called the fringing field regions) the electrical field created by applying RF/DC voltages to the quadrupole structure has a significant strength but deviates from the ideal field [*Hunter89] which is present only inside the quadrupole region and with approximately constant strength along the Z axis. (Conditions near the midpoint along the Z axis (FIG. 3B) correspond most closely to that assumed by traditional theory, that is, the ions are passing down a quadrupole of infinite length and are unperturbed by the entrance and exit conditions.)

Because the statically focused charged particles all have similar injection energies in the Z direction and enter the quadrupole field near its node of zero field strength in the radial (X-Y) direction, they experience forces from the entrance fringing fields that are small compared to the forces experienced in the exit fringing field. Inside the quadrupole electrode structure, conditions near the midpoint correspond most closely to that assumed by traditional theory, that is, the charged particles are passing down a near-ideal quadrupole field and are unperturbed by the entrance and exit conditions. Once within the quadrupole field, each charged particle will have a unique trajectory which reflects the initial injection position and exact initial ion velocity (both in three-dimensional space), and the time dependent phase of the RF field. Our computer simulations show that, in this region, the charged particles have periodic trajectories, similar to the one depicted in FIG. 2 of reference [*Davis90], with large displacements from the axis. Like in any periodic motion, this means that the charged particles spend most of their time near the turning points, i.e., away from the center axis of the device and near the electrodes. Since the oscillating RF field causes the charged particles to oscillate in the radial (X-Y) plane while moving down the Z axis at a constant speed, their instantaneous velocity in three-dimensional space can become quite large and hence their instantaneous kinetic energy can be significantly larger than the initial injection velocity and energy. To summarize, the charged particles absorb and lose substantial amounts of translational kinetic energy from the oscillating quadrupole field.

Thus, as the charged particles arrive at the terminal end of the quadrupole rods, their most probable spatial position will be near the rods (executing a turn) rather than near the center line, which was the case near the point of injection (see FIG. 2 of reference [*Davis90]). This means that the majority of the charged particles pass through the most turbulent and intense portions of the fringing field as they exit the device. As a result of this passage, charged particles will gain energy from the fringing fields as they exit through this region.

Previous calculations and experiments, including experimental ion imaging, [*Weaver78], [*Holme76], [*Holme78] have shown that ions near their limit of mass instability gain energy and exhibit substantial spatial dispersion as they exit through the fringing fields of the quadrupole mass filter. Traditional quadrupole mass selection, in RF-only mode or in RF/DC mode, requires the ions to exit the quadrupole near or at these instability limits. Hence, the ion spatial and energy distribution at the exit of the quadrupole mass filter will be very broad (see FIG. 3C and compare this to the photographs of FIGS. 8 through 11 in reference [*Weaver78].) Ions at a particular point in space in the plane defined by the ends of the quadrupole rods will have a range of energies and directions dependent on initial injection characteristics, the precise RF phase at injection and the position within the envelope of the stability diagram. Fixed static focusing elements, such as disclosed in U.S. Pat. No. 4,087,030, are unsuited for restoring the initial attributes of focal uniformity to ions exiting the fringing field. (See also the depicted single focal point ion optics depicted in the figures of U.S. Pat. No. 5,026,987.) This is because the individual ion trajectories vary widely in a time dependent manner, as described in the above references, whereas focussing schemes using static voltages can only focus the small portion of all exiting mass-selected ions having specific locations and energies. Therefore, devices designed in accordance with the prior art can only detect the small portion of all mass-selected charged particles or ions which actually exit the quadrupole, without collision with other structural features such as ion-optical lenses and apertures. Furthermore, non-mass-filtered particles can, in fact, traverse the quadrupole mass filter, exit from it with very high energy, and create spurious signals at the detector.

With these considerations in mind, the prior art attempts to improve detection efficiency and reduce noise will now be described.

High-Energy Conversion Dynodes

It is well known that the ability of an ion to trigger an amplification event in an electron multiplier is dependent on its velocity [*Buehler77]. U.S. Pat. No. 3,774,028 describes an ion detector in which an ion beam is accelerated towards a so-called conversion dynode by means of a large electrostatic field. The high energy and velocity with which the ions impinge on the surface result in the efficient release of secondary charged particles for amplification and detection. Named the Daly detector after its inventor, the original embodiment comprised a metal dynode, positioned 90 degrees off-axis to a truly focused ion beam exiting from a magnetic sector mass spectrometer, which was held at a high electrical potential in the range from 5 to 20 thousand volts. Ions of appropriate charge were accelerated into the metal plate, resulting in an avalanche of secondary particles, including neutrals, ions, electrons and photons. In the original embodiment, a photomultiplier was placed opposite to the dynode (90 degrees in the opposite direction from the dynode relative to the ion beam) and signal detection was made by detection of photons. Later, the photomultiplier tube was replaced with various charged particle detectors, including discrete dynode electron multipliers, channeltrons and multichannel plate (MCP) based detectors.

Detectors similar in concept to the Daly detector have been employed in quadrupole mass spectrometers. These detectors are commonly referred to as high-energy dynode detectors (HED). Because of detector triggering by non-mass-selected particle noise (described below) it is commonly understood that the opening of the electron multiplier must be placed off-axis, or that there must be a baffle preventing neutral particles exiting the quadrupole from hitting it. U.S. Pat. No. Re 33,344 of U.S. Pat. No. 4,423,324 describes such an apparatus and method for the detection of negative or positive ions. A simplified device capable of operating at up to 20 thousand volts without the problem of field emission from closely spaced support and focusing elements was developed [*Schoen88]. As in Daly's original invention, the high-energy conversion dynode in this device is placed at about 90 degrees relative to the exit plane of the quadrupole. Recently, other devices employing the HED concept in a confined area have been introduced which continue to represent a modest improvement to sensitivity over designs that do not employ a high-voltage field.

Using a high-energy conversion dynode to accelerate charged particles of high mass to high velocities to make their conversion more efficient was deemed to be sufficient to improve high-mass sensitivity. However, this hypothesis is not consistent with measurements made using non-quadrupole measurements [*Tobita87], and the degree of observed improvement is much greater than what would be accountable based on a momentum-based loss in conversion efficiency. Much more likely is that, in addition to a modest improvement in momentum triggering, the field created by the high voltage of the HED element improves the collection efficiency of the ions exiting the quadrupole fringing fields somewhat, up to the point where the potential penetrates into the rear of the quadrupole and causes charged particles to become unstable prior to exiting the mass filter.

Attempts to Reduce Particle Noise

Another area of concern in the prior art is the elimination of noise. As with most real measurements made under non-ideal conditions, the sensitivity, or limit of detection, is the ratio of actual signal to noise, in which the noise may be large relative to the sample's charged particle flux to the detector. In quadrupole mass spectrometers, some of the noise will be electronic. Another source of noise is chemical noise, which designates an undesired contribution of substances other than a compound of interest to the signal at specific m/z values of interest. However, chemical and electronic noise can be reduced relatively easily.

Discrete non-mass-selected particles formed inside the system constitute a much bigger problem. These particles can impact the detector with sufficient energy to cause the generation of spurious, non-mass-dependent signals. These signals have been attributed to a number of different phenomena:

(1) Photons from the ion source.

(2) "Soft" x-rays ejected upon ion impact on the quadrupole rods.

(3) Long lived excited state neutrals formed the ion source or along other locations along the ion optical axis.

(4) Stray charged particles from ionization gauges.

(5) High-energy scattered ions.

There is general agreement that non-mass-selected noise is enhanced in certain types of applications. For example, helium (He) is a common carrier gas in GC/MS applications and in such applications is present in the ion source at relatively high pressures in the $10^{-2}$ to $10^{-5}$ torr range. Under electron impact ionization, the helium, compared to which the sample constitutes only a trace component, is excited by electron impact to a long lived electronic excited state He* (20 eV internal energy) [*Donnelly69]. These neutral particles exit the ion source and pass through the mass filter without undergoing sufficient collisions with wall or electrode components or with the other neutral species to be quenched. Therefore, a significant portion of these excited neutral species can drift to the detector and carry sufficient internal energy to trigger the detector and cause a spurious, undesired signal.

The increasing demands of medical and biochemical mass analysis have ushered in new and powerful ionization techniques, such as electrospray and atmospheric ionization. Similar to GC/MS, these techniques use either air or pure nitrogen gas in which an electric discharges occurs, leading to the formation of excited state nitrogen, $N_2$* (sometimes called active or activated nitrogen). This species passing through the mass filter has the same effect of the spurious triggering of the detector. More complex techniques, such as collisional fragmentation of mass-selected beams by collision with a gas or surface, add other sources of non-mass-filtered, noise-generating particles.

It is generally accepted that an electron multiplier detector must be placed in an off-axis configuration to avoid spurious triggering of the electron multiplier by excited state neutrals. The prior art describes various designs to reduce this noise. U.S. Pat. No. 4,227,087 discloses an off-axis detector in which the charged particle beam is deflected off-axis prior to entering an electron multiplier. U.S. Pat. No. 4,047,030 describes a substantially on-axis detector with an electrostatic lens to deflect charged particles around a barrier to block neutral species before hitting the detector. Another approach that has been proposed is the use of a charged wire held taut across the exit of the quadrupole; it was thought that exiting ions would be captured in the wire's field and angular momentum would prevent them from actually hitting the wire. The captured ions would hence spiral 90 degrees off-axis to the detector [*Weiss80]. However, because mass-selected ions leaving the quadrupole are highly dispersed spatially and energetically in a time dependent manner due to the oscillating RF and asymmetric DC quadrupole fields, these elaborate static focusing schemes cannot effectively act to refocus the ions.

Alternative methods to minimize excited state species hitting the detector involve modifications at the entrance to the quadrupole mass spectrometer. For example, in a mass spectrometer designed for atmospheric ionization an asymmetric swerving motion of the ion beam prior to injection into the quadrupole is utilized [*Hu93]. Because the ion beam is statically focused upon entry into the quadrupole system, this method is somewhat effective. In another design, a bent RF-only multipole collision cell and ion guide are used to minimize particle noise [*Syka90].

In linear quadrupole mass spectrometers, which constitute the majority of designs available at the present time, the particle noise problems, particularly those associated with newer ionization techniques, are not satisfactorily addressed by the current off-axis detection schemes because they do not suppress high-energy scattered, non-mass-selected charged particles that exit from the quadrupole mass filter concurrent with the mass-filtered species of interest. Neither the bent multipole nor an off-axis ion source are easily adaptable to most existing, linear mass spectrometer designs and therefore do not represent attractive solutions to improve the performance of the large number of instruments already in operation.

Review of Limitations of the Prior Art

Much work has been done attempting to improve performance of the detection system in quadrupole mass spectrometers in order to improve sensitivity for higher masses and reduce noise. However, the prior art does not take into account certain properties of quadrupole mass spectrometer systems. In particular, the prior art in quadrupole mass spectrometer design is based on certain idealized assumptions:

1. It is assumed that mass-filtered, charged particles exit from the quadrupole in a beam which can be manipulated with apertures, lenses and high-voltage dynodes, without considering the possibility that those elements can cause charged particle loss in the fringing field or inside the quadrupole electrode structure.
2. It is assumed that the primary source of mass discrimination is decreased conversion efficiency at the detector, for example that lead-glass based electron multipliers themselves are less sensitive to high molecular weight species striking the detector at constant energy but lower velocity [*Reagan87]. These experiments typically have been conducted using quadrupole mass filters, with the implicit assumption that ion collection efficiencies at the end of the mass filter are independent of mass.
3. It is assumed that non-mass-filtered charged particles are neutralized inside the quadrupole electrode structure and that their possible transmission through the quadrupole mass filter is inconsequential for instrument performance.

The fundamental shortcomings of the prior art have kept quadrupole mass spectrometry from reaching its full efficiency and range of application. New ionization methods and biomolecule mass spectrometry make solving the twin problems of high-mass sensitivity and noise reduction particularly urgent. Because of the large investment in quadrupole mass spectrometers worldwide, and because annual sales of new mass spectrometers are small compared to the number of units already installed and in use, new and beneficial technologies that rely on cheap mass analysis will not soon reach end users unless the deficiencies of the prior art can be overcome in existing as well as newly manufactured instruments.

SUMMARY OF THE INVENTION

The present invention provides an apparatus and method for providing mass-selected particles. A mass filter adapted to receive a flux of particles at its entry emits a mass-selected subset of the received flux of particles at its exit, and an electrode configuration provides electric fields for deflecting at least some of the mass-selected subset of particles thus emitted across a substantially open spatial region through substantially 180 degrees of arc. The deflected particles can be collected, converted, fragmented, or detected. The apparatus and method are suitable for use with a multipole (e.g., quadrupole) mass filter, and the electrode configuration can easily be retrofitted to existing installed multipole mass spectrometers as well as adapted to newly manufactured designs.

A further understanding of the nature and advantages of the invention will become apparent by reference to the remaining portions of the specification and drawings.

BRIEF DESCRIPTION OF THE DRAWINGS

FIG. 5A is a potential energy surface;

FIG. 5B is a view from the back of the same potential energy surface as in FIG. 5A, illustrating an exemplary ion trajectory;

FIG. 5C is the potential energy surface as in FIG. 5B shown at a lower resolution and with correspondingly less truncation of the surface;

FIG. 6A is a surface at 1 mm from the end of the quadrupole;

FIG. 6B is a surface at 2 mm from the end of the quadrupole;

FIG. 6C is a surface at 3 mm from the end of the quadrupole;

FIG. 6D is a surface at 8 mm from the end of the quadrupole; and

FIG. 6E is a surface at 21 mm from the end of the quadrupole.

DESCRIPTION OF SPECIFIC EMBODIMENTS

Figure 1A:
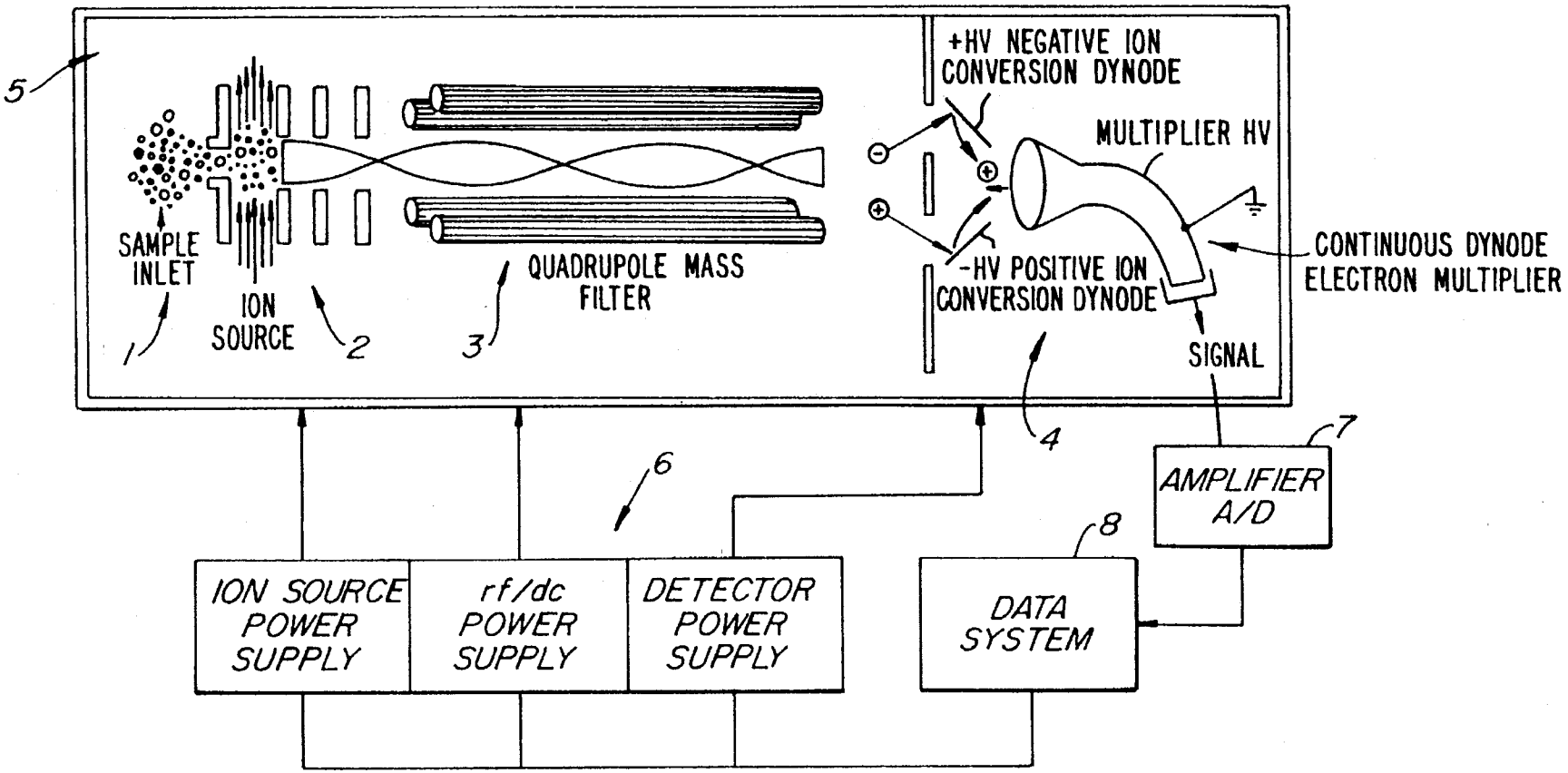
FIG. 1A. PRIOR ART
FIG. 1A is a schematic depiction of an apparatus including a quadrupole mass spectrometer fitted with a detector configuration in the prior art.

A specific embodiment of the invention is described in detail with reference to certain of the accompanying drawings (FIGS. 4A–4E, 5A–5C, and 6A–6E). This specific embodiment incorporates a quadrupole mass filter and a detector. The detector can be mounted atop the quadrupole mass filter in piggyback fashion.

Before discussing the drawings, it is helpful to begin with an overview of certain properties of the electric fields used in the present invention. The invention incorporates an electric field, generated by a suitable configuration of electrodes, through which charged particles pass as they exit through the fringing field region of a time-dependent multipole electric field of a mass spectrometer. The electric field produced by the electrode configuration deflects the charged particles through a well-defined area of space and thereby delivers the charged particles to the next stage of particle analysis, such as particle detection.

The two-fold criterion for the electric field in accordance with the present invention is as follows:

1. The spatial region immediately behind the quadrupole exit aperture is substantially open-that is, free from obstructions such as apertures, dynodes, baffles, or other structural members-and is substantially filled by the cone of excited state neutrals and the cone of high-energy scattered ions.
2. Within the open region immediately behind the quadrupole exit aperture, ions with a wide range of directions and focal points are turned. In other words, there is a bounded range of unique focal points, with the large, unobstructed spatial volume fulfilling the criterion of such a range of focal points. Given this large bounded range of focal points, there exists a detector geometry that can capture ions over this bounded range while at the same time avoiding capture of the neutral and scattered ion cones.

According to the present invention, an electrode configuration for spatially tailoring the fields is bounded within a specific volume of space including the inner portion of the quadrupole rods and the volume element of space behind the quadrupole exit aperture, through which there exists a broad but bounded spatial range of mass-selected charged particle trajectories. The field created by the electrode configuration has several characteristics:

1. It enables the charged particles to exit the inner portion of the quadrupole such that the external fields for charged particle collection do not themselves cause charged particle loss within the quadrupole device.

2. It allows the charged particles to pass free from the exit region bound by the multipole field, including exit apertures, with charged particles having a spatially broad but bounded range of trajectories and energies, and without the charged particles suffering excessive loss from striking structural members of the electrode configuration.
3. It causes the mass-selected charged particles to execute a turn of approximately 180 degrees relative to their averaged direction upon exiting the multipole field, to pass away and beyond the cone of non-mass-selected particles and excited state neutral species.
4. It causes the charged particles to impinge upon or pass though an area of space that lies substantially in the plane of the quadrupole exit or exit aperture and thus urges said charged particles toward the next stage of particle analysis. The net effect of these forces is to generate a large ion-optic static focusing area that constitutes a focusing element with a wide range of focal points.

Figure 4A:
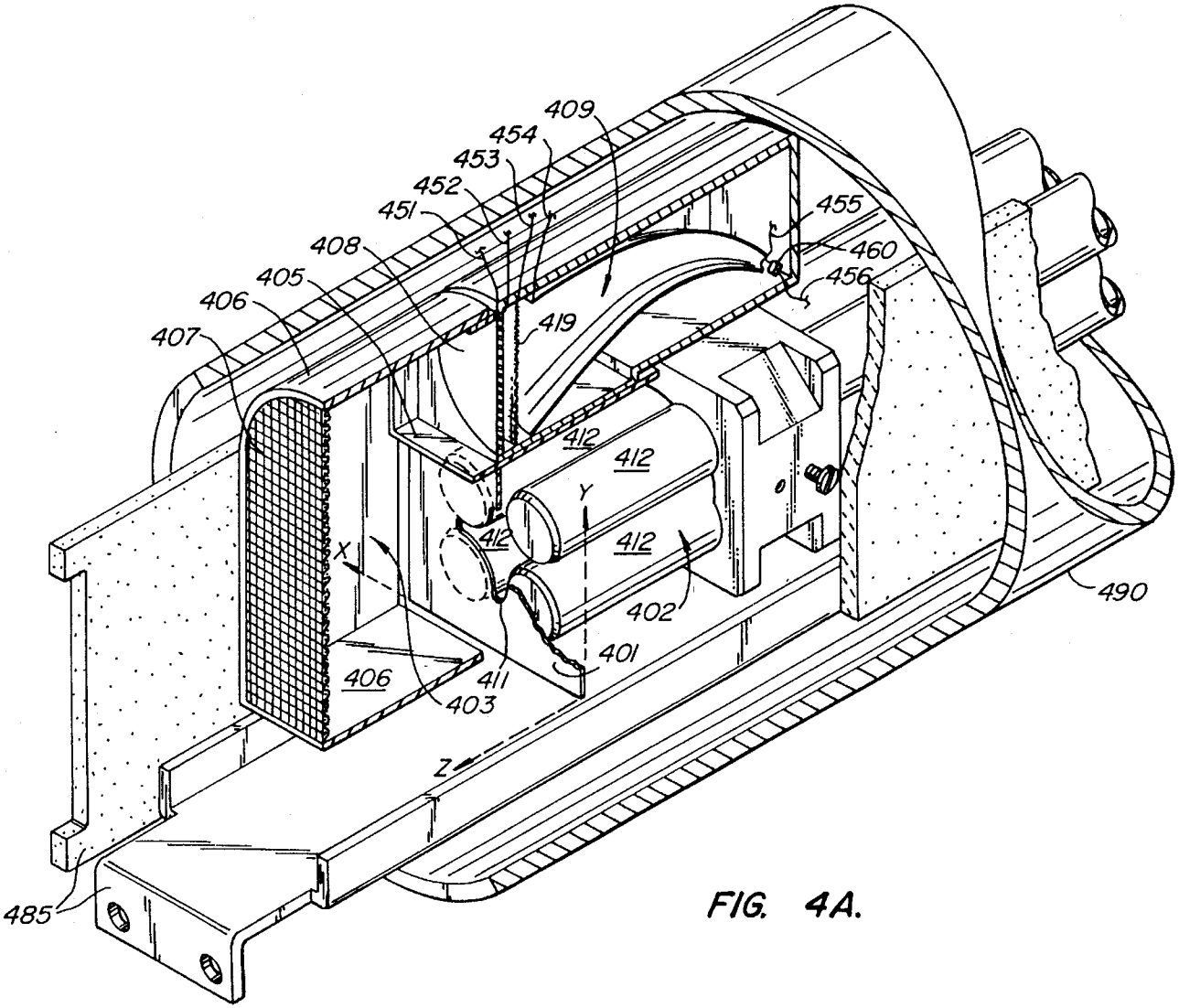
FIG. 4A is a perspective view of an apparatus including a quadrupole mass spectrometer fitted with an electrode configuration and a piggyback detector according to the invention.

Turning now to the drawings, FIG. 4A depicts a cutaway perspective view of the electrode configuration that gives rise to the ion-optic electric fields (to be shown in FIGS. 5A–5C and 6A–6E). The electrodes are intended to deflect the exiting beam of mass-selected ions with a very broad range of focal points to an electron multiplier positioned outside of the cone for neutral and scattered ions, in a plane substantially parallel with the plane defined by the ends of the quadrupole electrode structure. According to the present invention, the electric field produced by the electrode configuration causes the mass-selected ion beam to make substantially a 180-degree turn with starting and ending focal points over a very wide area.

The specific embodiment is a piggyback detector design (FIG. 4A), in which the detection area surface is substantially in plane with the quadrupole exit plane. The relative placement of the detector with respect to the quadrupole exit plane is particularly important. The ions must execute a deflection through an arc of substantially 180 degrees. However, this deflection must be allowed to occur over a large spatial volume. The large spatial volume for deflection is provided by a substantially open or empty region at the exit aperture of and immediately behind the quadrupole mass filter.

Field-Generating Electrode Structure

An electrode structure to generate the electrical fields according to the present invention will now be described. The electrodes that make up this structure are shown in FIG. 4A and typical voltages that can be applied to these electrodes are given below. In this embodiment, an aperture electrode 401 at the exit of a quadrupole mass filter 402 terminates the quadrupole field generated by the rods 412 of quadrupole mass filter 402 and minimizes the perturbation of the RF and DC fields into the substantially open volume 403 behind the quadrupole exit.

Aperture electrode 401 provides the ion entrance into the substantially open volume 403 behind quadrupole mass filter 402. Aperture electrode 401 also defines the field boundary for a multichannel plate (MCP) 408 used in the specific embodiment. A ledge 405 acts to define a partition between the ion exit onto MCP 408 and the ion entrance from the quadrupole mass filter 402. Peripheral field electrode 406 defines the outer boundaries to the substantially open volume 403 behind the exit of quadrupole mass filter 402. A grid 407, held at the same potential as the peripheral field electrode 406, allows unwanted neutrals and high-energy scattered ions to exit the substantially open volume 403, thus avoiding their deflection into the detector. Aperture electrode 401, peripheral field electrode 406, grid 407, and MCP 408 together substantially define the boundaries of a chamber that encloses substantially open volume 403.

Above aperture electrode 401 and substantially in the plane defined by the rearward ends of rods 412 of quadrupole mass filter 402 is located MCP 408. Facing the other side of MCP 408 is a channeltron electron multiplier (channeltron) 409. MCP 408 creates an attractive potential for mass-selected ions exiting from the quadrupole mass filter 402 through aperture electrode 401. These mass-selected ions strike MCP 408, and their impact results in the release of a number of secondary electrons proportional to the number of incident ions. These secondary electrons are attracted to the channeltron 409, where their signal is amplified. The output current of channeltron 409 thus provides a measure of the intensity of the ion beam exiting from the mass filter.

It will be apparent to those skilled in the art of ion detection that MCP 408 and channeltron 409 can be replaced in other embodiments by other ion-optical or detection devices, for example, a Faraday collector, a discrete dynode multiplier, or a channeltron electron multiplier array (CEMA). More generally, any suitable ion-optical or detection apparatus can be used to which a sufficient potential is applied to deflect ions by substantially 180 degrees. Typically such apparatus has at least one opening through which the mass-selected ions diverted by the fields can pass.

Figure 2A:
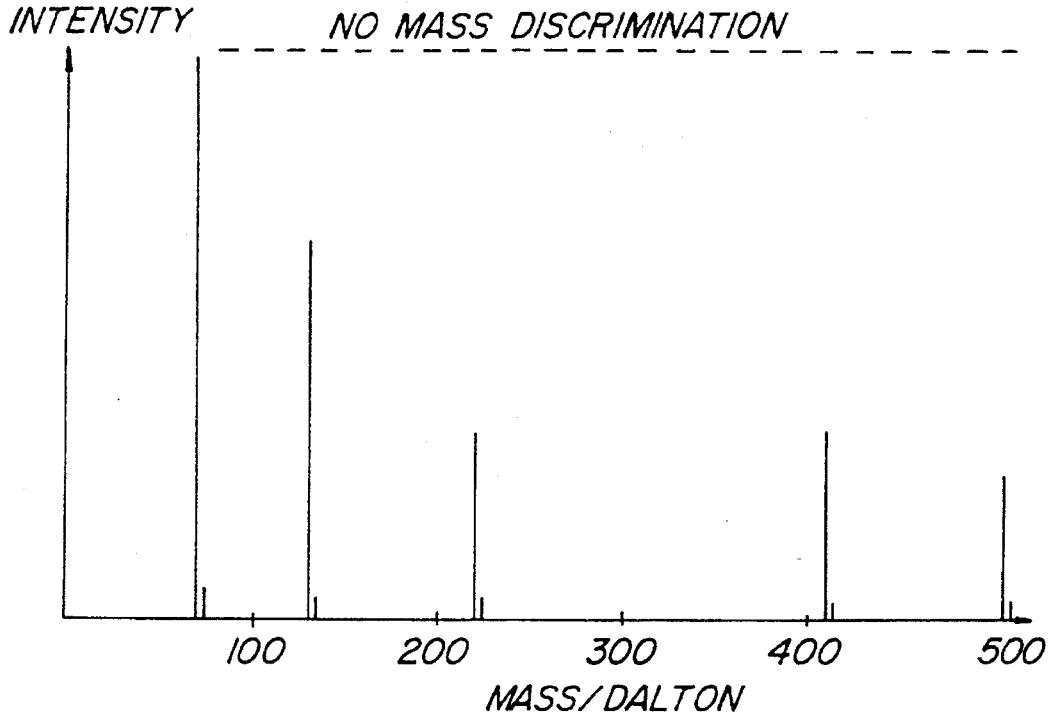
FIG. 2A is a theoretical mass spectrum without mass discrimination produced by scanning the RF and DC voltages applied to a quadrupole mass filter.
Figure 2B:
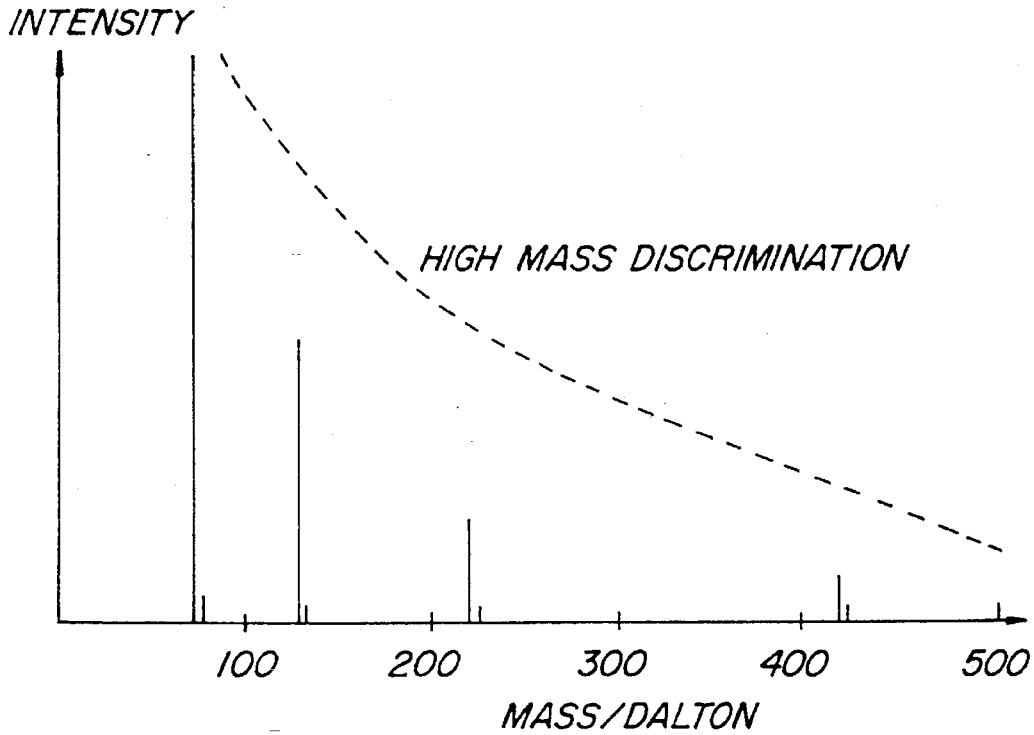
FIG. 2B. PRIOR ART
FIG. 2B is a typical mass spectrum produced by scanning the RF and DC voltages applied to a quadrupole mass filter in the prior art, showing a drop in relative abundance of detected mass-selected ions with increasing mass compared to their true abundance in the ion source.
Figure 4C:
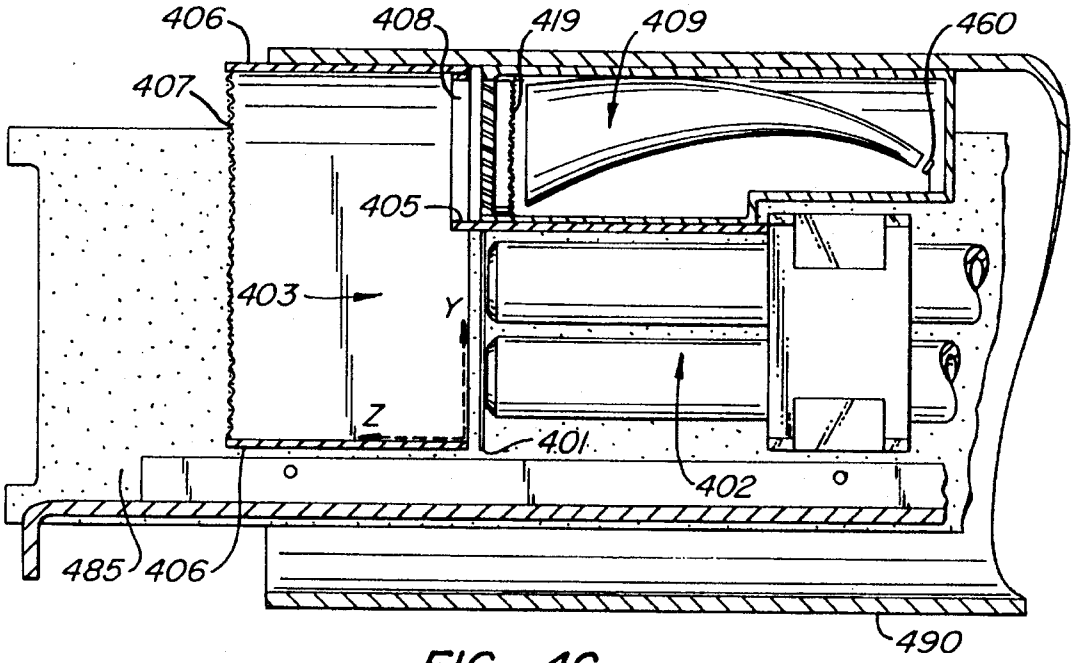
FIG. 4C is a side view of the apparatus of FIG. 4A.
Figure 4B:
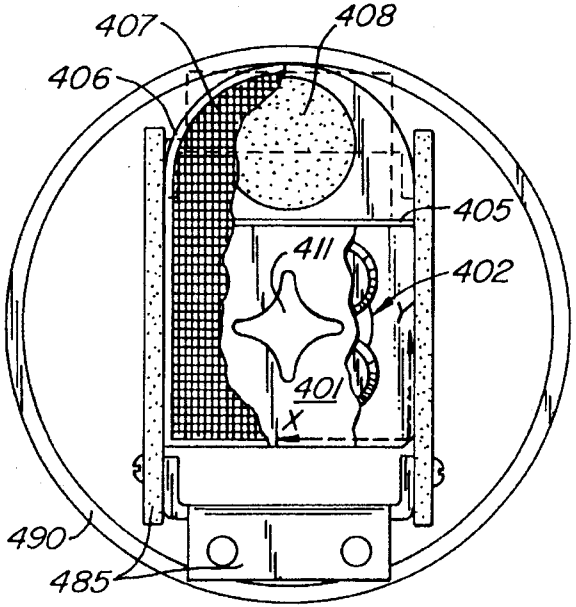
FIG. 4B is an end view of the apparatus of FIG. 4A.

The opening (aperture) 411 of aperture electrode 401 can be in the shape of a rounded cross as depicted in FIG. 4B. This shape minimizes the RF and DC field penetration emanating from the ends of quadrupole rods 412. At the same time, the rounded cross shape tends to minimize the perturbation that any field terminating aperture has on the field within quadrupole mass filter 402. A cross section of this field is shown in FIG. 2C (see also reference [*Dawson76].) Because the nodal portion (virtual ground plane) of the DC and instantaneous RF voltage applied to the quadrupole represents the most repulsive component of the effective potential, allowing its penetration thorough the arms of the cross aperture acts to minimize ion loss at the aperture.

Also shown in FIG. 4A are detector leads 451, 452, 453, 454, 455, and signal lead 456. Detector leads 451, 452, 453, 454, 455 are used to maintain various components of the detector assembly at desired potentials. Signal lead 456 is used to transmit a signal produced by channeltron 409. It is connected to a channeltron multiplier collector plate 460 that is positioned at the narrow end of channeltron 409. Following is a description of the leads along with exemplary values for their voltages:

(1) Lead 451, connected to front of MCP 408: −5000 volts.

(2) Lead 452, connected to rear of MCP 408: −4300 volts (that is, the rear of MCP 408 is biased +700 volts with respect to the front of MCP 408).

(3) Lead 453, connected to channeltron grid 419: −3000 volts. (Channeltron grid 419 is a small grid that is mounted in front of channeltron 409, and is not to be confused with grid 407.)

(4) Lead 454, connected to front of channeltron 409: −1500 volts.

(5) Lead 455, connected to rear of channeltron 409: −100 volts.

(6) Signal lead 456: 0 volts (ground potential). This voltage can also be floated in certain embodiments, such as the MS/MS setup that is described below.

Peripheral field electrode 406 and grid 407 are typically held at a voltage of, for example, plus or minus 190 volts (the sign is equal to the sign of the charge of the mass-selected particles). Vacuum vessel 490, which surrounds the mass filter, detector, and electrode assembly, is typically held at ground potential.

In FIG. 4B, quadrupole rods 412 and MCP 408 are shown in outline. Also shown is the outline of peripheral field electrode 406. The upper boundary above the exit aperture onto the MCP and below the partition ledge 405 is semicircular. A typical value for the width of partition ledge 405 would be $0.5\times r_0$, where $r_0$ is one half the distance between diagonally opposing quadrupole rods. In one embodiment with $r_0$= 10 mm, the width of the ledge is 5 mm.

In FIG. 4C, a Y-Z plane cross section of the electrode arrangement is shown. Grid 407 is across the substantially open volume 403 from exit aperture electrode 401. Partition ledge 405 projects out beyond the end of quadrupole mass filter 402 and between aperture electrode 401 and MCP 408.

Figure 4D:
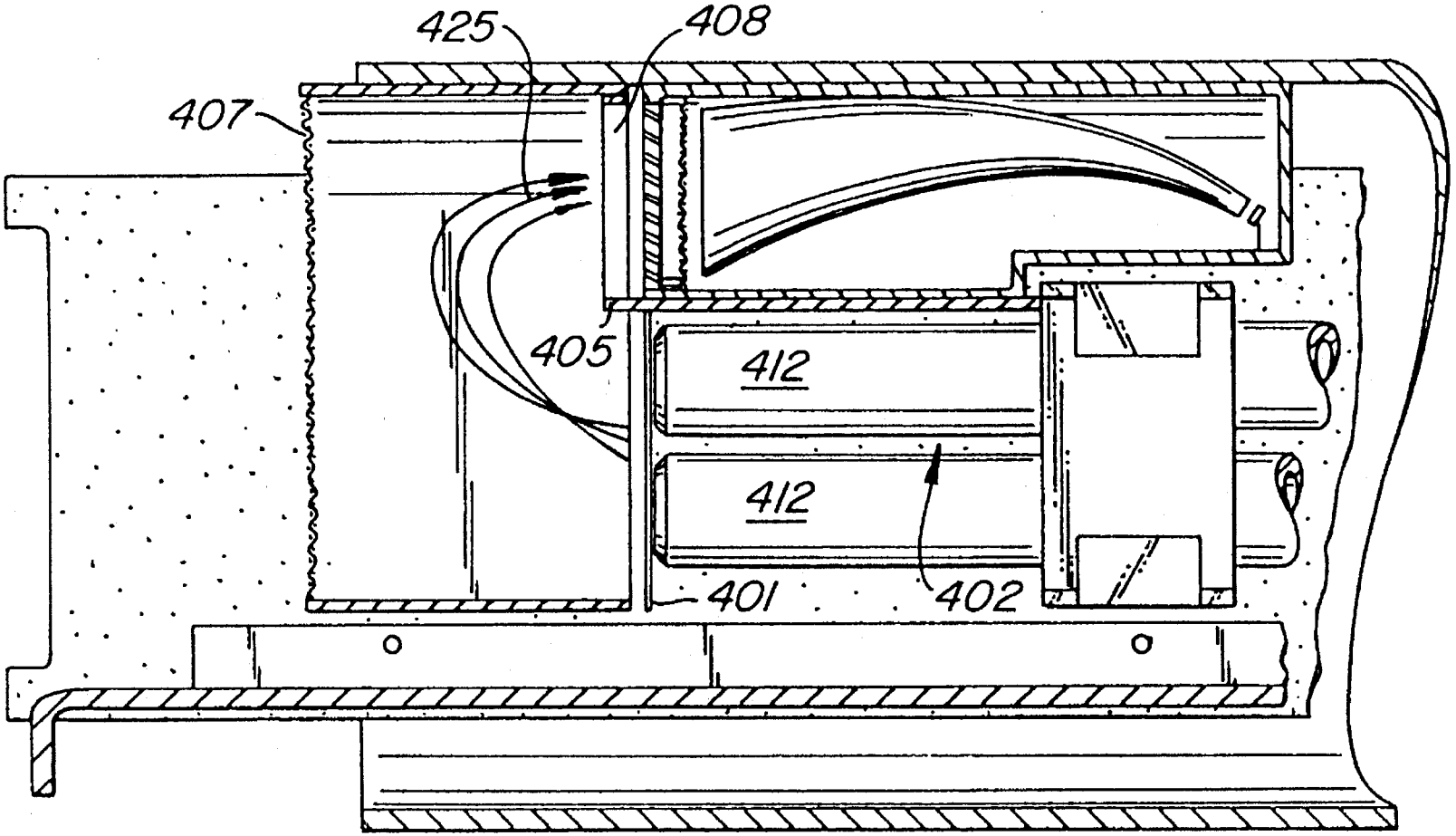
FIG. 4D is the side view of FIG. 4C, with the addition of arrows to show the general direction of charged particle trajectories in the apparatus.

FIG. 4D is the same as FIG. 4C, except that arrows 425 have been added to illustrate, schematically and in a simplified way, the average general direction of the trajectories followed by the mass-selected charged particles diverted by the electric fields. Mass-selected particles emerge through aperture electrode 401 and are deflected through substantially 180 degrees of arc across substantially open volume 403 to MCP 408, where they become available for the next stage of analysis—typically, collection, conversion, fragmentation, or (as shown in FIG. 4D) detection.

(To persons skilled in the art, the terms collection, detection, fragmentation and conversion have certain general meanings which can be loosely summarized as follows: Collection refers to directing ions to a particular region in space with the purpose of making them available for further analysis. Detection refers to measurement of the ion current. Fragmentation refers to a process in which the original ion (parent ion) is dissociated into two or more neutral and charged particles (neutral fragments and daughter ions), the mass of which equals the mass of the original parent ion. Conversion refers to the conversion of an ion to a different charged or uncharged species; for example, an ion impinging on a suitable surface may result in the neutralization of the ion and the emission of one or more electrons.)

Figure 4E:
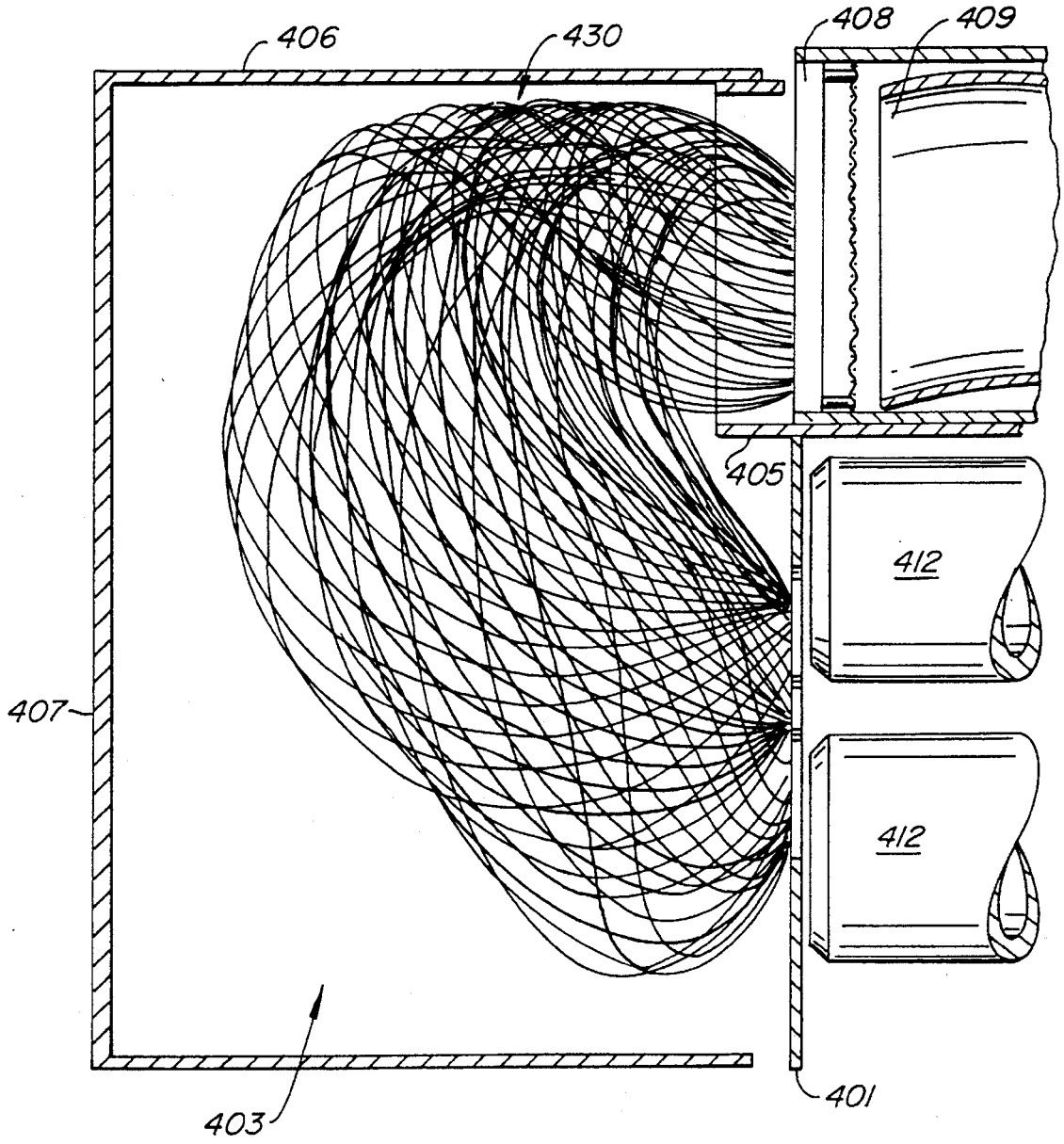
FIG. 4E is a schematic illustration of charged particle trajectories in an apparatus according to the invention.

FIG. 4E is another schematic, simplified depiction of trajectories of the diverted charged particles. A close-up view of substantially open volume 403 is shown, with certain details omitted for clarity. A cloud of trajectories 430 emanates from the vicinity of aperture electrode 401, passes through substantially 180 degrees of arc across substantially open volume 403, and converges in the vicinity of MCP 408. Typically the trajectories are quite complicated, and they can be even more complicated at a microscopic level than is apparent from the schematic illustration here.

Effective Potential

Although the ion-optic potentials governed by the present invention are predominantly static, the influence of the penetrating RF fields in the region near opening 411 of aperture electrode 401, commonly referred to as the fringing fields, must also be considered. The ion-optic contributions which the RF fields have on the static DC fields can be evaluated by methods developed by Dehmelt (for a detailed discussion, see U.S. Pat. No. 5,206,506 and references therein.) According to Dehmelt, the RF fields can be treated as a so-called "effective potential" which is additive to the static DC potential. The effective potential plays an important role in the spatial dispersion of ions as they exit the quadrupole mass filter. The contribution by the effective potential is always repulsive, and is given by $$U_{eff}(x,y,z)=\frac{|F(x,y,z)|^2}{4m\Omega^2}+U_{DC}(x,y,z)$$

where $U_{eff}(x,y,z)$ is the effective potential experienced by an ion at spatial location x,y,z which includes both RF and DC components F(x,y,z) is the maximum force experienced by an ion during an RF period at spatial location x,y,z m is the ion mass Ω is the RF frequency UDC is the contribution from the electrostatic potential only.

Electric Potential Contours

The electric potentials characterizing the invention can be represented graphically by potential surfaces and contours. The sign and magnitude of the forces experienced by a charged particle at a particular location on the potential surface depends on the sign and multiplicity of the charge. To provide an intuitive illustration of the potential, the graphs of FIGS. 5A–5C and 6A–6E show potential energy surfaces and contours, expressed in units of electron volts (eV), for a singly charged particle. Particles will move in the direction of the largest gradient.

The potential energy distribution assigns a value to every point in three-dimensional space. This field cannot be fully represented in a single drawing. Rather, cuts through the field structure are taken (similar to slicing a loaf of bread) and the potential energy in the plane of each cut is plotted as the third dimension.

The coordinate system shown in FIGS. 4A–4C is used to represent the potential surface and contour diagrams in FIGS. 5A–5C and 6A–6E. The X and Y axes are perpendicular to rods 412 of quadrupole mass filter 402, while the Z axis is parallel to them. More particularly, the X axis is horizontal and parallel to partition ledge 405, and the Y axis is vertical and parallel to grid 407.

The approximate proportions to the volume bounded between the aperture electrode and the peripheral field electrode in X, Y, and Z is 1:2:1. (More generally, an aspect ratio Z/Y-the ratio of the distance Z between grid 407 and aperture electrode 401 to the distance Y between MCP 408 and the longitudinal axis of quadrupole mass filter 402-of between 0.1 and 10.0 is typical of embodiments of the present invention.) Mass-selected ions exiting the quadrupole mass filter 402 are turned approximately 180 degrees and deflected in the Y direction, resulting in a arc trajectory from the quadrupole mass filter 402 to MCP 408.

The electrodes described above with reference to FIGS. 4A–4C contribute to the electric potentials according to the present invention. The exemplary values assigned to them for the purpose of generating FIGS. 5A–5C and 6A–6E are:

(1) The RF and DC voltages applied to quadrupole rods 412 are ±1141 volts and ±150 volts, respectively. These voltages result in mass selection of a singly charged ion at approximately 800 amu at moderate resolution for a device of the overall dimensions used in the specific embodiment. The RF frequency is 1 MHz.

(2) Aperture electrode 401 is set to 0 volts.

(3) Peripheral field electrode 406 and grid electrode 407 are set to 190 volts.

(4) MCP 408 is set to −5000 volts.

Again, these voltages are exemplary. The exact voltages used depend on the mass-to-charge ratio of the selected particle flux. Preferably, the minimum ratio of the magnitude of the voltage at MCP 408 to the magnitude of the voltage at peripheral field electrode 406 is approximately 5:1.

Figure 1B:
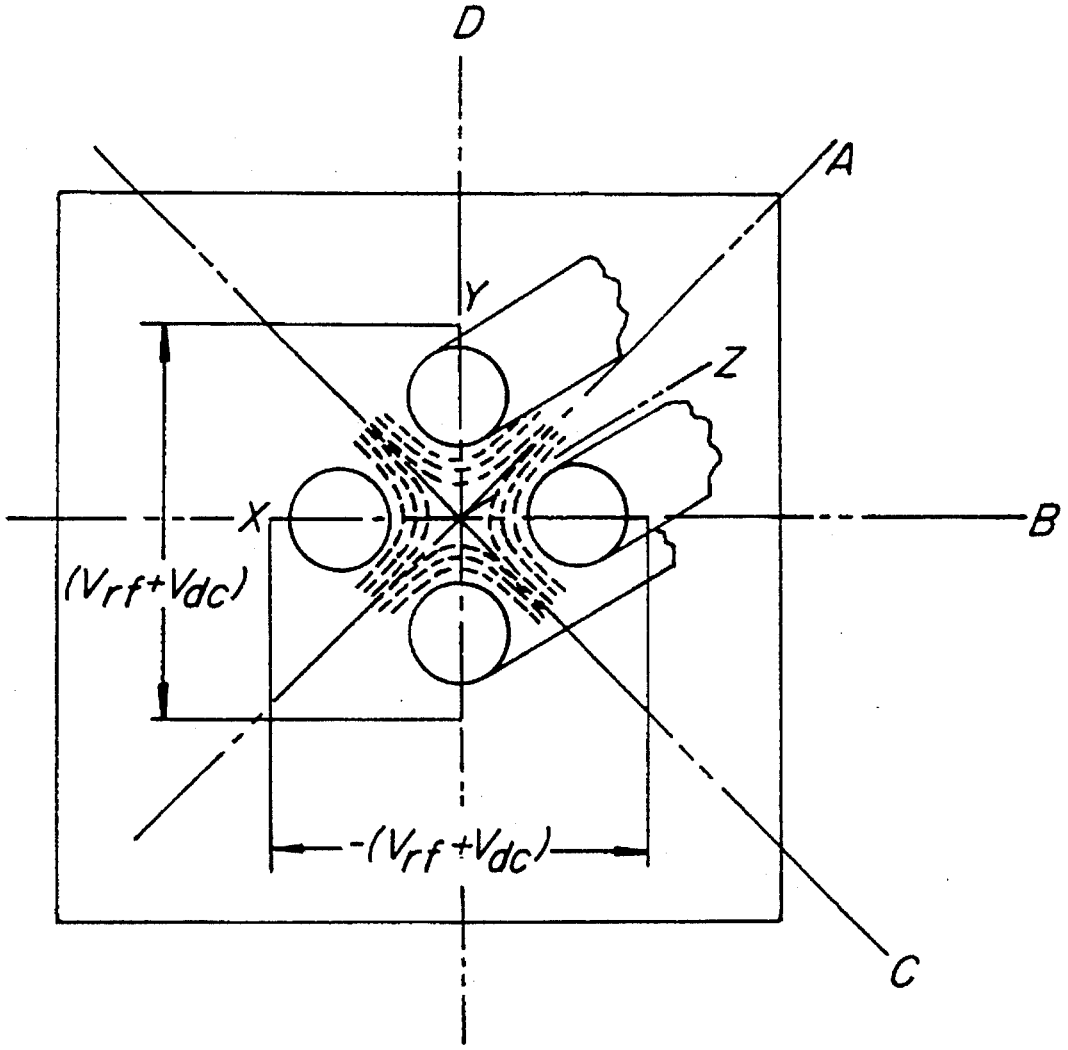
FIG. 1B illustrates the RF/DC fields of the quadrupole rods.
Figure 5A:
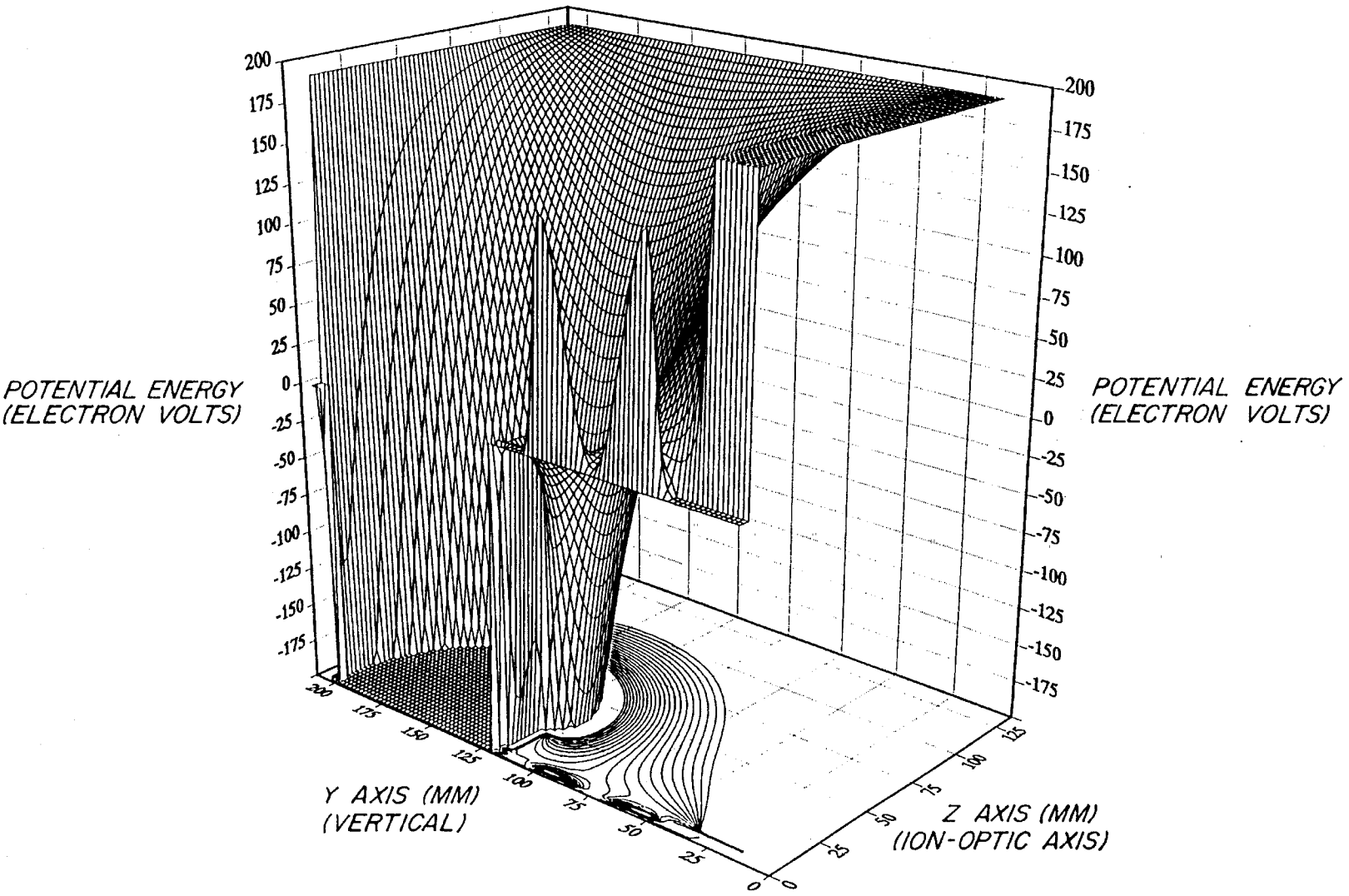
FIGS. 5A–5C are three views of a potential energy surfaces represented in cut parallel to the Z axis.
Figure 5B:
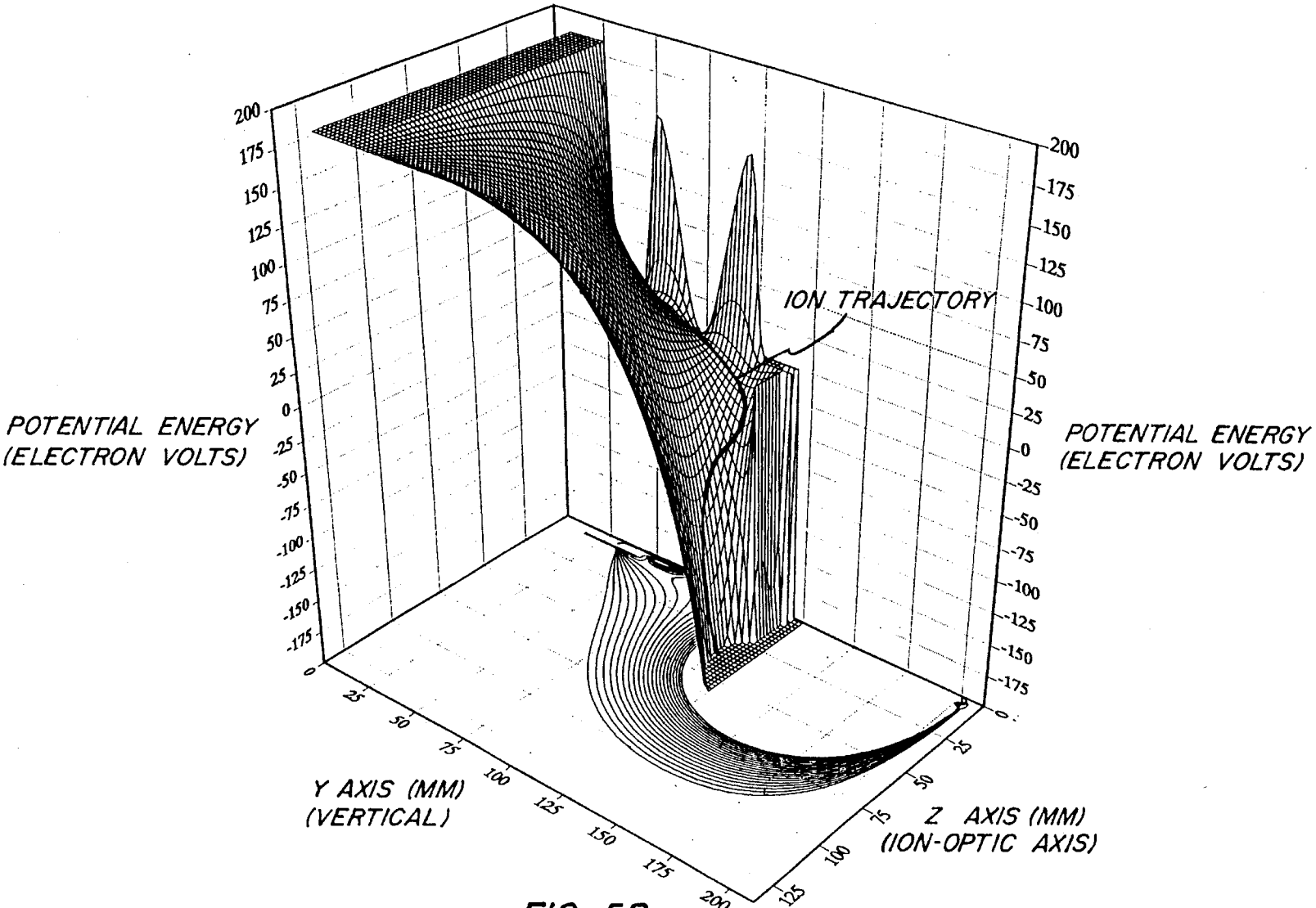
Figure 5C:
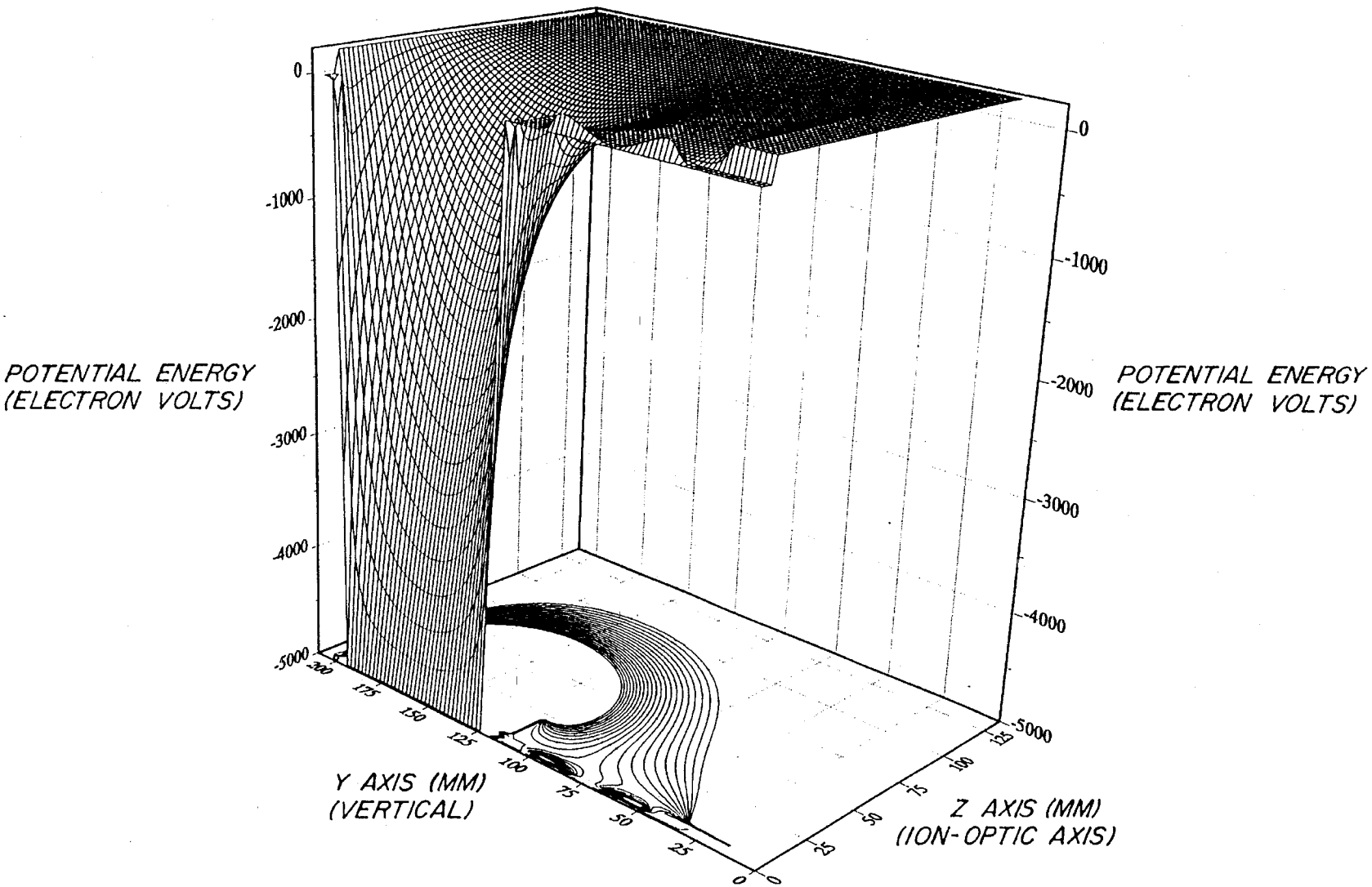

Referring now to FIGS. 5A–5C, potential energy surfaces are represented in a number of cuts parallel to the Z axis; the orientation of the cuts is indicated by the lines labelled A, B, C and D in FIG. 1B. Note that A and C are orthogonal while B and D are symmetrically equivalent. Two views of the cut along A are shown in FIGS. 5A and 5B. With the origin of the X and Y axes as shown in FIG. 4B, the cut intersects the aperture electrode at X=20 mm. The origin of the Z axis is in the plane of aperture electrode 401. Accordingly, at Y=0 and Z=0, the field is terminated to the aperture electrode potential of 0 volts. A short distance in Z away from aperture electrode 401, peripheral field electrode 406 draws the potential energy surface to a maximum of 190 electron volts. The cross-shaped opening 411 in aperture electrode 401 is located along the Y axis between 15 and 33 mm; traveling along the Y axis (Z=0), the effective potential assumes two local maxima where the spacing between quadrupole rods 412 is closest.

Ions exiting quadrupole mass filter 402 along the Z axis oscillate back and forth in the potential trough between these local maxima in much the way a marble moves in a channel. Traveling even further along the Y axis, the potential energy well created by the voltage applied to MCP 408 is evident. As soon as ions have moved away from the quadrupole exit region by some Z distance, they will feel the effect of the potential well and be rapidly drawn towards it. The potential well provided by the high attractive potential at MCP 408 is analogous to a funnel that captures the diverted particles and directs them to their target. FIG. 5B provides a view from the back of the same potential energy surface as in FIG. 5A, illustrating an exemplary ion trajectory.

The potential surfaces reveal a key feature of the present invention, namely that, despite the close proximity between MCP 408 and aperture electrode 401 behind quadrupole mass filter 402, the high MCP potential (typically, −5000 volts) does not contribute significantly to the potential near opening 411 of aperture electrode 401, nor does it penetrate through opening 411 of aperture electrode 401 into the end region of the quadrupole mass filter 402. The narrow ledge 405 provides this shielding effect without itself becoming a target for ion loss through collision. However, ions exiting towards peripheral electrode 406 are deflected and irreversibly trapped in the potential well created by MCP 408. Note that the potential surfaces in FIGS. 5A and 5B have been truncated for the purposes of the illustration. The full potential is illustrated in FIG. 5C. This illustration shows that the quadrupole exit region is very effectively shielded from the deep potential energy well.

The surfaces and contours following in FIGS. 6A–E are taken in the X-Y plane for Z values of 1, 2, 3, 8 and 21 mm respectively from the end of the quadrupole.

Figure 6A:
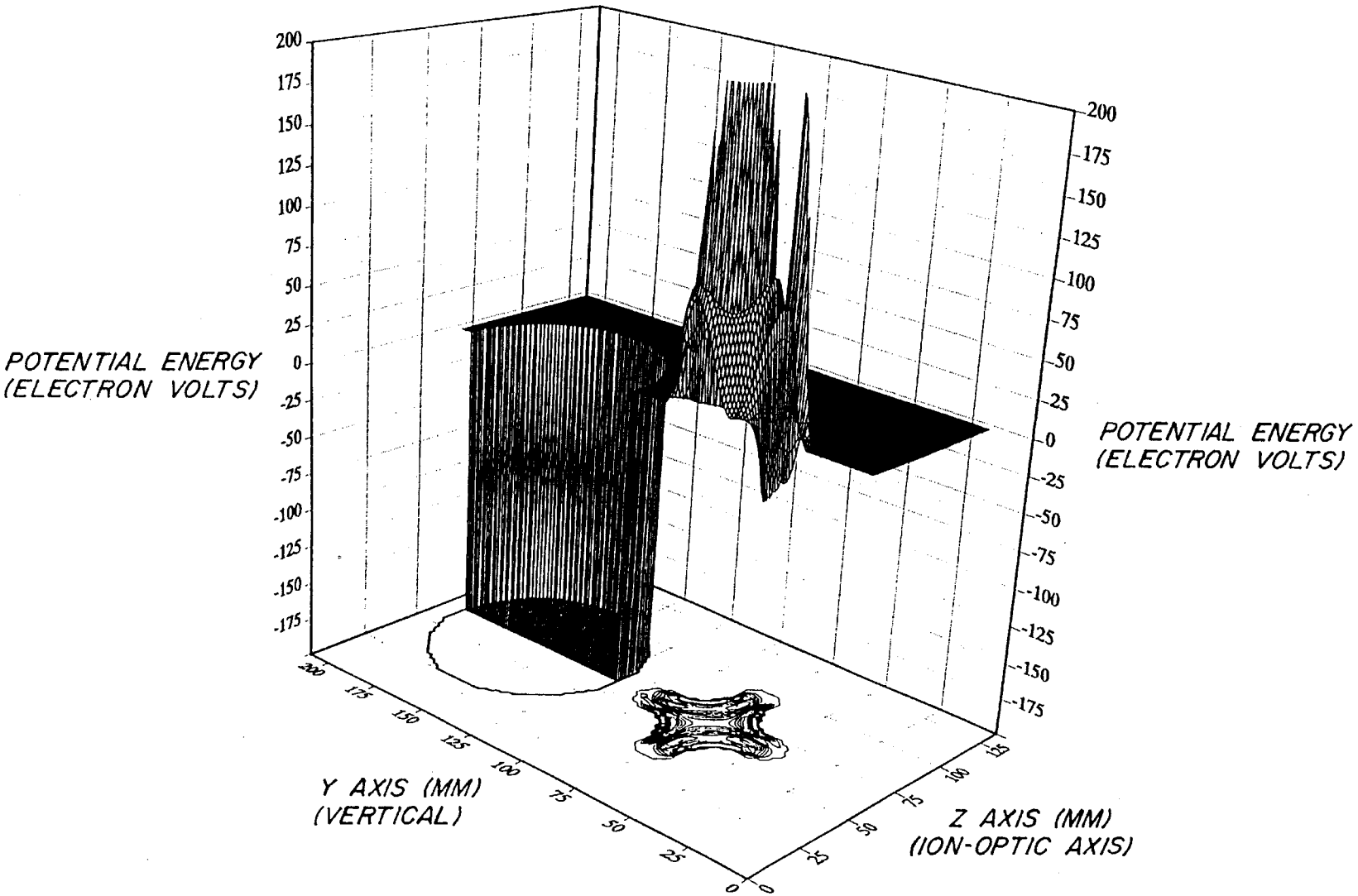
FIGS. 6A–6E are a series of potential energy surfaces taken in the X-Y plane for varying Z values, where the X-Y plane is parallel to the exit plane of the quadrupole mass filter and the Z axis is parallel to the quadrupole mass filter's longitudinal axis.

FIG. 6A illustrates the potential surface in the X-Y plane and lying in the plane the aperture electrode 401. The potential surface is identical to the potential on the electrode which is 0 volts except within the openings constituting the apertures. The potential near the quadrupole exit aperture is dominated by the effective potential. The sharp repulsive potential rising at the edges of the aperture reflects the monopole potential set up between the rod ends and the grounded aperture plate. The magnitudes are unequal because one rod set is biased at +150 volts while the second is at −150 volts DC. As the ions move though this plane, they are confined within the elongated trough depicted more fully in the contour. There is no connection between the highly negative MCP voltage and the quadrupole exit in the plane of the aperture electrode.

Figure 6B:
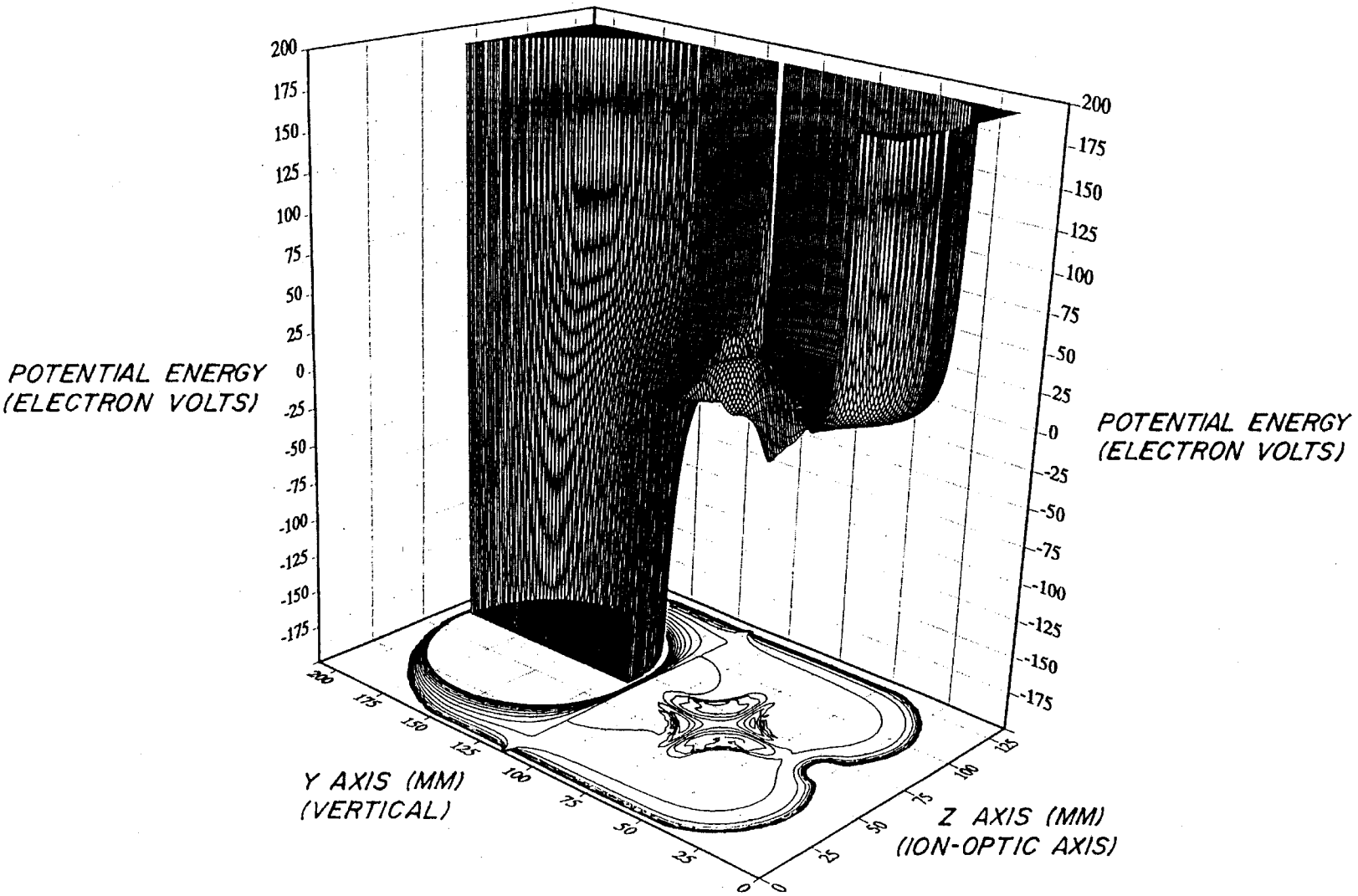

FIG. 6B depicts the potential surface just beyond the aperture electrode at a distance of 1 mm beyond the quadrupole rods as measured on the Z axis. The region in the vicinity of the quadrupole aperture is still dominated by the RF and DC effective potential, despite the close proximity of the MCP. As can also be seen from FIG. 5A, the partition ledge effectively prevents field penetration from the MCP from perturbing the natural RF fields. Conversely, the DC repulsive potential of the peripheral electrode is effectively terminated by the aperture electrode before significant field penetration into the quadrupole has occurred. Note also that the magnitude of the effective potential has decreased by more than a factor of 2 from that shown within the plane of the aperture electrode itself.

Figure 6C:
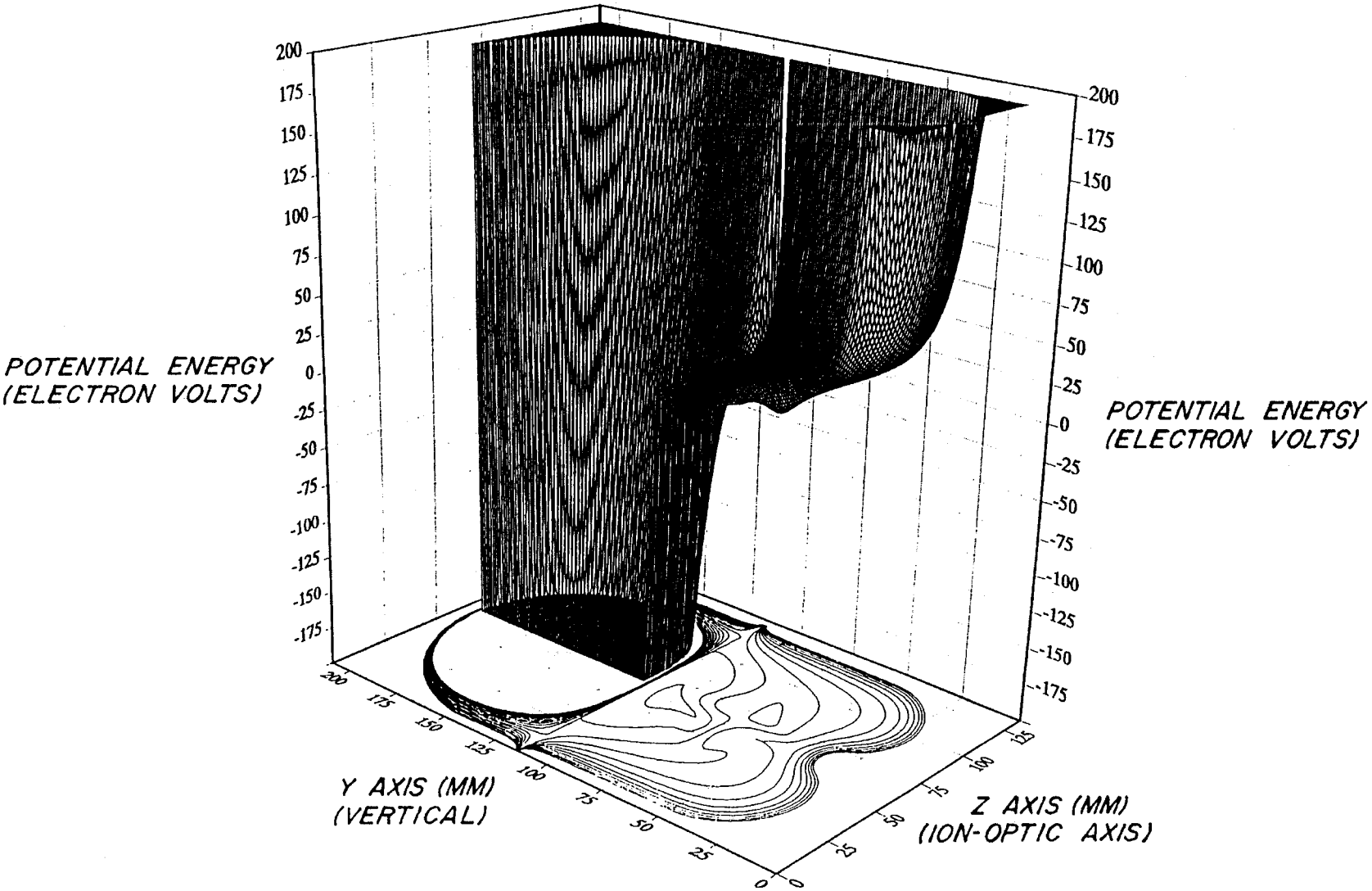

FIG. 6C depicts the potential surface 2 mm above the aperture electrode and 3 mm beyond the ends of the quadrupole rods. Although it is just below the level of the partition ledge, field penetration from both the MCP as well as from the repulsive peripheral potential is small. Field penetration from the quadrupole has become small and comparable in magnitude to the contributions from the other electrodes. Ions passing through this plane would have trajectories defined by the exiting fringing fields of the quadrupole.

Figure 6D:
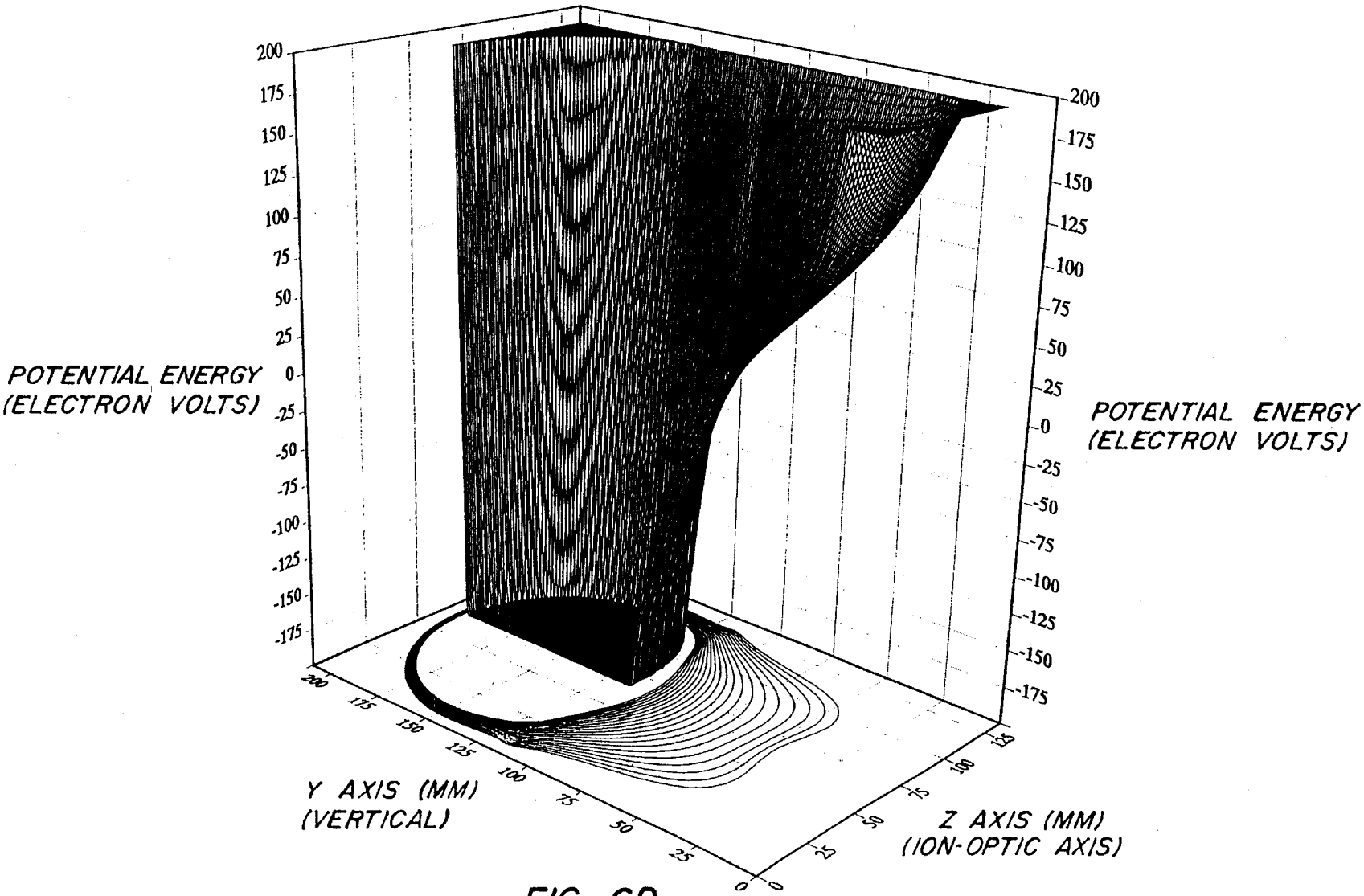

FIG. 6D depicts the potential surface 6 mm above the aperture plate. Ions passing though this plane are accelerated towards the MCP down the now steep gradient formed between the opposing potential contributions of the MCP and the peripheral field electrode. Ions pass above the partition ledge in an arc. Note the perturbation from the grounded partition ledge is still observable as a depression in the potential surface at a Y value of approximately 110 mm and along the X axis.

Figure 6E:
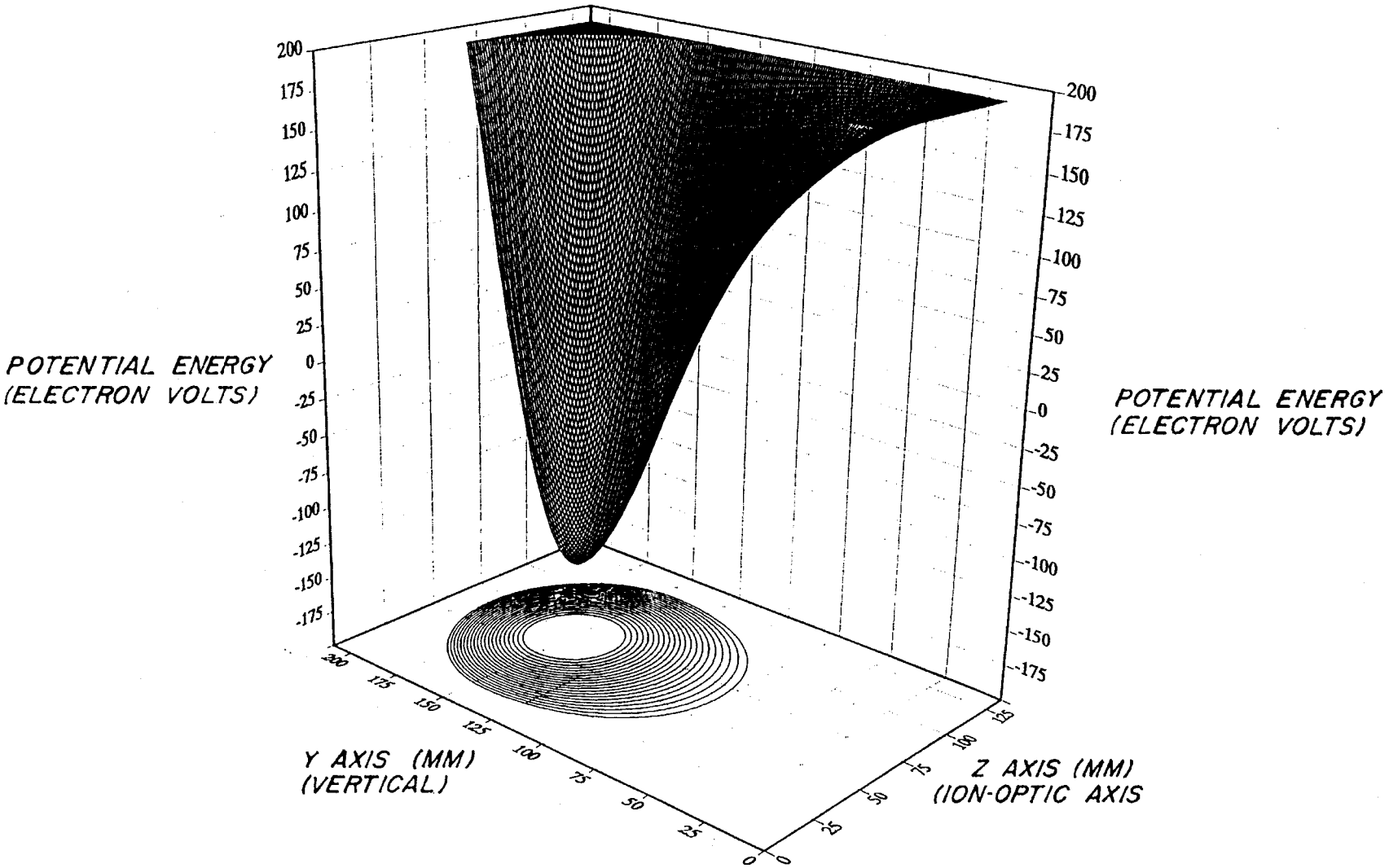

FIG. 6E depicts the potential surface some 21 mm above the quadrupole rod ends. Forces on ions in this X-Y plane accelerate ions toward the center of the MCP. At the same time, inspection of FIGS. 5A–5C reveals equally strong forces accelerating the ions towards the center of the MCP in the Y-Z planes. The combination of these forces results in a three-dimensional 180-degree deflection of ions in a broad arc between the exit aperture and the MCP.

Scanning and Optimizing Voltages

As described above, the exemplary values assigned to electrode voltages for the purpose of generating the potential surfaces of FIGS. 5A–5C and 6A–6E are fixed DC voltages. Also according to the present invention, certain voltages (in particular the voltages on peripheral field electrode 406 and grid 407) can be varied in a mass or time-dependent manner within a voltage range of approximately the inverse of the MCP voltage (for example, −5000 volts to +5000 volts.)

Typically, a charged particle of lower mass-to-charge value will require less voltage than a charged particle of higher mass-to-charge ratio.

Two exemplary methods to optimize applied voltages are as follows:

1. For a given combination of RF and DC voltages applied to the multipole rods which results in the preferred transmission or mass selection of a particular mass-to-charge ratio, vary the voltage on peripheral field electrode 406 and grid 407 between its minimum and maximum until the charged particle current registered by the detector is maximized.
2. For a scan of RF and DC voltages applied to the multipole rods which results in the subsequent preferred transmission or mass selection of a range of particular mass-to-charge ratio, ranging from a first mass-to-charge value to a second mass-to-charge value, vary the voltage on peripheral field electrode 406 and grid 407 between a first voltage and a second voltage in proportion to the RF voltage in such a way that the signal for the first mass is maximized when the first voltage is applied and the signal for the second mass is optimized when the second voltage is applied.

Alternative Embodiments

The invention is not limited to the detection of charged particles upon their exit from the quadrupole mass filter. Charged particles prepared according to the present invention can be used for other purposes.

For instance, an MS/MS experiment can be performed on ions deflected about 180 degrees to the area of space above and substantially in the plane of the exit of the quadrupole rod system. In an MS/MS experiment, these so-called parent ions can be subjected to collisions with a gas or a surface located in that area, resulting in the formation of so-called daughter ions which can be further analyzed to provide useful information.

After fragmentation, daughter ions can be collected and processed in one of several ways in the present invention. For example, another quadrupole mass analyzer could be mounted substantially parallel to the first analyzer. In one simple configuration, a retarding grid is mounted between the MCP and the channeltron multiplier. In the configuration shown schematically in FIG. 4B, an MCP is used to perform surface-induced dissociation (SID) [*Aberth88], and the retarding channeltron grid is used for energy analysis and (indirectly) mass analysis of daughter ions. For example, the following experiment can be performed:

1. Adjust the quadrupole RF and DC voltages to mass-select a parent ion of mass-to-charge ratio M.
2. Apply a voltage $V_1$ (for example, −5000 volts) to the front of the MCP.
3. Apply a voltage $V_2$ such that the back of the MCP is biased slightly negatively relative to the front (for example, −5050 volts). This will prevent electron multiplication from occurring (for electron multiplication, the back of the MCP has a positive bias of typically 700 volts.)
4. Apply a voltage $V_3$ (for example, −5100 volts) to the front of the channeltron, and float the back of the channeltron at a voltage $V_4$ (for example, −3500 volts.)
5. Allow parent ions to collide with the MCP surface. These parent ions will have a kinetic energy of approximately $E=n\times q\times V_1$, with n=number of charges, e=elementary charge.
6. The collision will result in the formation of daughter ions $M_1$, $M_2$, . . . with energies $E_1$, $E_2$, . . . Because of the law of energy conservation, $E_1+E_2+\ldots=E=\text{const}$.
7. Now scan the voltage of the retarding channeltron grid (for example, from 0 to −5000 volts.) Only those ions that have an energy equal to or larger to the potential difference between the grid and the back of the MCP will be able to pass through the grid, strike the channeltron and be detected.
8. Record an ion current signal as function of the grid voltage, and apply analog or digital processing to extract the daughter ion energy or mass spectrum.

While a specific example is given to an MS/MS experiment, the scope and intent of the invention is not limited to the specific apparatus and method described. The following will be appreciated by those skilled in the art:

1. A different fragmentation mechanism can be substituted in place of the MCP, for example, a metal plate or a gas-filled chamber with one or more openings.
2. The electrode arrangements can be modified to result in better daughter ion resolution or a simpler experimental setup. For example, a second MCP or conversion dynode can be employed in order to avoid floating the channel electron multiplier. Also, additional grids, lenses, or other ion-optic elements can be used.
3. Voltages applied to the various electrodes can be modulated or pulsed. For example, the grid voltage can be modulated at the threshold for a particular daughter ion energy, resulting in an alternating-current (AC) signal from the detector superimposed on top of a direct-current (DC) background which can be easily filtered out to provide a signal component specific to the selected daughter ion only.
4. A second mass filter, a magnetic sector apparatus, or a time-of-flight analyzer can be employed for mass or energy analysis following the initial fragmentation step.

Retrofit Considerations

One significant benefit of the present invention is that it can easily be retrofitted to existing mass spectrometers in the field. The purpose of the retrofit is to replace the original detector in a mass spectrometer by an electrode and detector assembly according to the present invention. Following is a description of how this can be accomplished.

FIG. 1A schematically shows the arrangement of the detector in a conventional quadrupole mass spectrometer. In such a device, the ion source, quadrupole rods and detector are mounted on a retaining structure using standard screws. The retaining structure 485 is also shown in FIGS. 4A–4B. The entire assembly is then inserted into vacuum vessel 490. In mass spectrometers built according to this design, the original detector can easily be removed using conventional hand tools such as screwdrivers, wrenches, and pliers.

After removing the original detector, an electrode and detector assembly according to the present invention can be attached to the mounting mechanism provided with the original assembly with simple sheet metal brackets and screws, again using ordinary hand tools. FIGS. 4A and 4B show the present invention installed in a conventional quadrupole mass filter assembly. Note that volume occupied by the original detector is now substantially empty and surrounded by the grid and peripheral field electrode, as prescribed by the present invention. In the embodiment shown in FIG. 4A, the high-voltage electrode (MCP 408) and channeltron 409 are mounted piggyback on top of quadrupole mass filter 402 in such a way that the completed assembly still fits into vacuum vessel 490.

Also, existing electrical connections and feed-throughs can be used to provide voltages necessary to operate the present invention retrofitted to an existing mass spectrometer. In a retrofit installed as shown in FIG. 4A, signal lead 456 from channeltron collector plate 460 is connected in place of the original detector's signal lead so that the original mass spectrometer data acquisition system is utilized without any modification. Any voltages not provided by the existing mass spectrometer electronics can easily be provided by external power supplies.

A person skilled in the art will realize that depending on the particular type of mass spectrometer to be retrofitted, and the mode of operation of the present invention, more extensive changes to the existing mass spectrometer may have to be made. For example, it can be necessary in some embodiments to provide a new vacuum chamber to fit all the components, in particular if a second mass analyzer is used with the present invention in MS/MS mode. It can also be necessary in some embodiments to add electrical connections and external electronic circuits to drive these additional components.

Some Advantages of the Invention

The present invention provides numerous benefits and advantages over the prior art. By way of illustration and not of limitation, some of these advantages will now be described.

The large open region immediately behind the quadrupole mass filter exit aperture according to the present invention represents a significant departure from prior-art mass spectrometer designs in which the volume immediately behind the quadrupole mass filter exit is occupied by aperture plates, dynodes, baffles, and other structural members. In such prior art designs, many of the high-mass ions are lost by collisions with such members. The substantially 180-degree arc traversed by the mass-selected ion beam also marks a significant departure from prior art designs. Even in 90-degree off-axis geometries of the prior art, ion loss occurs because of field penetration from the dynode and the need for baffles to prevent the detection of scattered ions.

The net effect of the forces produced by the electrode configuration of the invention is to generate a large ion-optic static focusing area that constitutes a focusing element with a wide range of focal points. This is distinct from the prior art in which focal properties were applicable only over a narrow range of focal points, and, which resulted in field perturbations into the quadrupole itself, and, which relied on an ineffective arrangement of apertures and baffles to attempt to block particle noise, while causing loss of mass-selected ions with these structural members. In the prior art it was incorrectly assumed that the mass-selected ions exiting the quadrupole were focusable based on limited focal point static ion optics.

The invention provides ion-optic apparatus for efficiently collecting ions dispersed over a wide (but bounded) range at the end of the mass filter and redirecting them, without losses by collisions with baffles, restrictive apertures, field-perturbing grids at the quadrupole exit, or other structural members, into a local collection area. The invention does not expose the exit portion of the quadrupole to extensive field penetration, which causes instability and loss of ions while they are still inside the quadrupole. Likewise, the invention does not require the use of field grids at the quadrupole exit, which can lead to field perturbation and ion loss both within the quadrupole and at the grids themselves. Moreover, the invention discriminates effectively against non-mass-selected particles, and also against particle noise such as excited-state neutrals, scattered ions, photons and other forms of particle noise, without resulting in significant losses to the mass-selected ions.

The invention is applicable not only to new instruments but may economically and efficiently be used to upgrade instruments already in the field, making them more efficient in their present use and suitable for adaptation to new applications requiring better high-mass sensitivity and lower noise. The invention provides a simple, economical and effective means to add additional capabilities such as surface-induced dissociation (SID).

An electrode configuration that satisfies the challenging constraints of time-variant spatial focusing can be deployed in the available volume of a majority of mass spectrometers without major modifications to their structural components, so that the present invention readily can be used in retrofitting existing mass spectrometers. By necessity, the electron multiplier cannot occupy the traditional detector volume. In contrast, the 90-degree off-axis geometry as taught in the prior art is generally uninteresting for field improvements to existing instruments because of the restrictions on spatial requirements.

The invention addresses a major need to collect, detect, fragment, or convert these ions in order to extract useful information about the sample. In order to better understand this, it is useful to review the consequence to ions of their passage through a quadrupole mass filter. After passing through the quadrupole mass filter, the ions exiting from the quadrupole are spatially dispersed and have a broad distribution of energies (compared to the relatively narrow energy distribution which they possessed upon entrance to the quadrupole device). The design of the present invention explicitly takes into account this spatial dispersion and energy distribution.

The present invention overcomes certain disadvantages of conventional quadrupole mass filter designs related to charged particle collection, conversion, fragmentation or detection upon exit of charged particles from the mass filter. The invention maximizes the number of mass-selected charged particles passing through a region of space, located near the exit of a multipole field used for mass analysis, over a wide mass range and while being subject to numerous practical constraints imposed by the basic physics of the device incorporating the multipole field.

Conclusion

The present invention provides a new and efficient apparatus and method for gathering mass-selected charged particles for further use. This includes the delivery of a primary mass-selected beam to a collector, a detector, a stage for conversion to other charged particles, or to a stage for fragmentation yielding secondary ions, e.g., for MS/MS analysis. The invention provides a large flux of mass-selected ions through a well-defined region of space.

The present invention provides improved detection of mass-selected charged particles exiting from a quadrupole field while discriminating against noise created by other charged and uncharged particles. The invention minimizes the non-mass-selected particle noise associated with present and new ionization techniques, such as GC/MS, LC/MS, electrospray and atmospheric ionization.

The present invention satisfies in a simple and cost-effective manner the arbitrary constraints imposed by the commercial evolution of practical mass spectrometers. Given the large number of existing mass spectrometers in world wide operation suffering from shortcomings of their design, this invention provides for a simple, practical, and economical field upgrade kit to significantly and substantially improve the performance of existing mass spectrometers.

The invention has been explained with reference to specific embodiments. Other embodiments are contemplated without departing from the spirit and scope of the invention. For example, in some embodiments, the particle beam can be pulsed rather than continuous. It is therefore not intended that this invention be limited, except as indicated by the appended claims.

References

[Aberth88] Aberth "Use of a Microchannel Plate for Surface Induced Dissociation (McSID)," *Proceedings of the 36th ASMS Conference on Mass Spectrometry and Allied Topics,* Jun. 5–10, 1988, p. 73.

[Buehler77] Beuhler and Friedman, *Int. J. Mass Spectrom. Ion Phys.,* 3:81–97 (1977).

[Davis90] Davis et al. "Computer Modelling of Fragmentation Processes in Radio Frequency Multipole Collision Cells," *Rapid Commun. Mass Spectrom.* 4:186–197 (1990).

[Dawson76] *Quadrupole Mass Spectrometry and Its Applications* (ed. P. H. Dawson, Elsevier, Amsterdam, 1976), p. 10.

[Donnelly69] Donnelly et al. "Detection of Metastable Atoms and Molecules with Continuous Channel Electron Multipliers," *Rev. Sci. Instr.* (1969), p. 1242.

[Holme76] Holme, A. E. *Int. J. Mass Spectrom, Ion Physics,* 22:11 (1976).

[Holme78] Holme et al., *Int. J. Mass Spectrom. Ion Physics,* 26:191 (1978).

[Hu93] Hu et al. "Inductively Coupled Plasma Mass Spectrometry with an Enlarged Sampling Orifice and Offset Ion Lens. I. Ion Trajectories and Detector Performance," *J. Am. Soc. Mass Spectrom.* 4:16–27 (1993) and references therein.

Figures 3A, 3B, 3C:
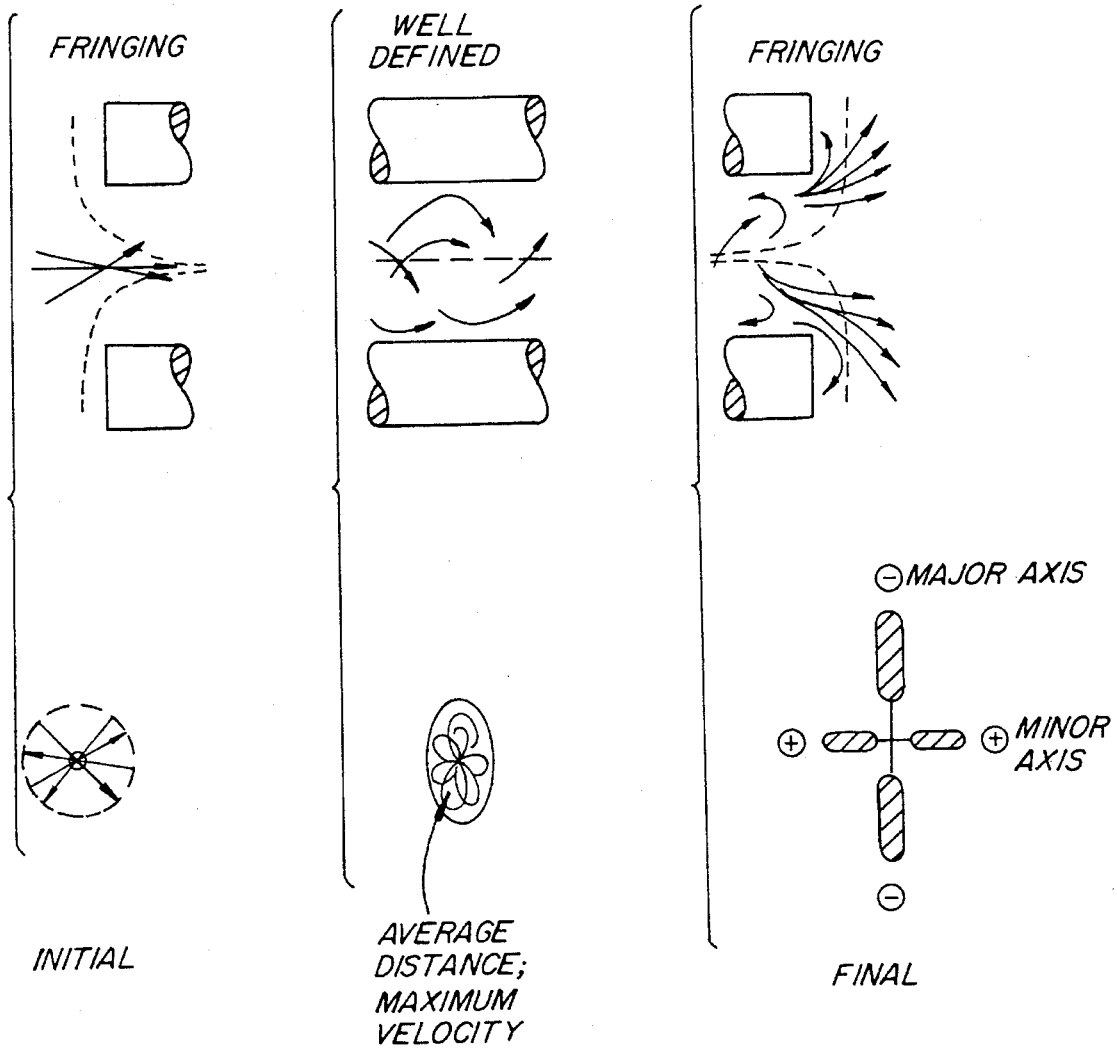
FIG. 3A is a schematic depiction of the fringing fields near the entrance to a quadrupole mass filter.
FIG. 3B is a schematic depiction of the quadrupole fields in the interior of a quadrupole mass filter.
FIG. 3C is a schematic depiction of the fringing fields near the exit of a quadrupole mass filter.

[Hunter89] Hunter et al. "An Improved Model of the Fringing Fields of a Quadrupole Mass Filter," *J. Mass Spectrom. Ion Proc.* 87:157–164 (1989) (e.g., FIG. 3).

[Reagan87] Reagan et al. "Mass-dependent Effects of Channel Electron Multipliers in Residual Gas Analyzers," *J. Vac. Sci. Technol.* A5(4):2389–2392 (1987).

[Schoen88] Schoen et al. "Improvement in High Mass Ion Detection of a Tandem Quadrupole Mass Spectrometer Using a High Voltage Post-Acceleration Detector," in *Proceedings of the 36th ASMS Conference on Mass Spectrometry and Allied Topics* (1988) p. 843.

[Syka90] Syka et al. "Characteristics of Linear and Non-Linear R. F.—Only Quadrupole Collision Cells," *Int. J. Mass Spectrom. Ion Processes* 96:97–109 (1990).

[Tobita87] Tobita et al. "Absolute Detection Efficiency of a Microchannel-Plate Detector for Ions and Neutrals," *Japanese J. Applied Physics* 26(3):509–510 (1987).

[Todd75] Todd et al. *Quadrupole Mass Spectrometry* (ed. A. Macoll, Butterworth and Co., London, 1975), Chapter 7.

[Weaver78] Weaver et al. "Modulation Techniques Applied to Quadrupole Mass Spectrometry," in *Dynamic Mass Spectrometry* (eds. D. Pierce and J. F. J. Todd, Heyden, London), Chapter 3, V.5. (1978).

[Weiss80] Weiss "Quadrupole Detection System with High Dynamic Range Amplifier," in *Advances in Mass Spectrometry,* 8:1624 (1980).

What is claimed is:

1. An apparatus for providing mass-selected particles, comprising:

mass filter means adapted to receive a flux of particles at an entry and to emit a mass-selected subset of said received flux of particles at an exit; and electric field means for deflecting at least some of said mass-selected subset of particles thus emitted across a substantially open spatial region through substantially 180 degrees of arc.

2. An apparatus for providing charged particles of a preferentially selected mass-to-charge ratio, comprising:

means comprising a multipole mass filter for providing a flux of charged particles of said preferentially selected mass-to-charge ratio, said flux having an average initial direction of propagation; and an electrode configuration for generating an electric field for deflecting at least a portion of said flux through a substantially open spatial region substantially 180 degrees from said average initial direction of propagation to a new average direction of propagation.

3. A mass spectrometer comprising:

a multipole mass filter means having a first end, a second end, and an interior region between said first and second ends, said multipole mass filter means being configured to receive a flux of particles at said first end, transmit said flux of particles thus received through said interior region while mass-selecting a subset of charged particles from said flux thus transmitted, and emit said mass-selected subset of charged particles at said second end; and electrode means for providing an electric field for diverting at least some charged particles of said mass-selected subset of charged particles through at least one trajectory passing through a substantially open spatial region and comprising an arc of substantially 180 degrees.

4. The mass spectrometer of claim 3 additionally comprising conductive shielding means for minimizing penetration of said electric field into said interior region.

5. The mass spectrometer of claim 3 additionally comprising grid means located in the vicinity of said second end through which can pass at least a portion of particles of said transmitted flux, said portion being emitted at said second end and not being diverted by said electrode means.

6. The mass spectrometer of claim 3 wherein the electrode means includes a shaped exit aperture electrode located at said second end.

7. The mass spectrometer of claim 6 wherein the shaped exit aperture electrode comprises a cruciform-cut plate.

8. The mass spectrometer of claim 6 additionally comprising a conductive ledge projecting from said shaped exit aperture electrode for minimizing penetration of said electric field into said interior region.

9. The mass spectrometer of claim 3 wherein the multipole mass filter means is a quadrupole mass filter means comprising rods subject to a time-varying radio frequency (RF) electromagnetic field.

10. The mass spectrometer of claim 3 wherein the electrode means includes a peripheral field electrode subject to a voltage.

11. The mass spectrometer of claim 10 wherein:

said multipole mass filter means comprises rods subject to a scanned radio frequency (RF) voltage; and said electrode means includes a peripheral field electrode, said peripheral field electrode being subject to a voltage that is scanned in proportion to said RF voltage.

12. The mass spectrometer of claim 10 wherein said peripheral field electrode is subject to a voltage that is optimized for a particular mass-to-charge ratio.

13. The mass spectrometer of claim 3 wherein the electrode means includes a high-voltage plate having at least one opening.

14. The mass spectrometer of claim 3 wherein the electrode means includes a multichannel plate.

15. The mass spectrometer of claim 3 additionally comprising a means for performing on said diverted charged particles an operation selected from the group consisting of collection, conversion, fragmentation, and detection.

16. The mass spectrometer of claim 3 additionally comprising a detector means for detecting at least a portion of said diverted charged particles.

17. The mass spectrometer of claim 16 wherein said detector means comprises a device selected from the group consisting of a channeltron electron multiplier, a Faraday collector, a discrete dynode multiplier, or a multichannel plate (MCP).

18. The mass spectrometer of claim 16 wherein said detector means is mounted piggyback atop said multipole mass filter means.

19. The mass spectrometer of claim 3 additionally comprising another multipole mass filter means for receiving and further mass-filtering said diverted charged particles.

20. The mass spectrometer of claim 3 additionally comprising a particle source means for providing said flux of particles.

21. The mass spectrometer of claim 20 wherein said particle source means comprises:

a sample inlet for introducing a sample into said particle source means; and means for converting said introduced sample into an at least partially charged flux of particles.

22. An apparatus for retrofitting a mass spectrometer, said mass spectrometer comprising a multipole mass filter means emitting a flux of mass-selected particles, said apparatus comprising:

electrode means for providing an electric field for diverting at least some particles of said flux of mass-selected particles through at least one trajectory passing through a substantially open spatial region and comprising an arc of substantially 180 degrees; and means for operationally coupling said electrode means to said multipole mass filter means.

23. The apparatus of claim 22 additionally comprising a means for performing on said diverted particles an operation selected from the group consisting of collection, conversion, fragmentation, and detection.

24. The apparatus of claim 22 additionally comprising a detector means for detecting at least a portion of said diverted particles.

25. The apparatus of claim 24 wherein said detector means comprises a device selected from the group consisting of a channeltron electron multiplier, a Faraday collector, a discrete dynode multiplier, or a multichannel plate.

26. A method for providing mass-selected particles, comprising the steps of:

emitting a flux of particles at an exit of a multipole mass filter; and applying an electric field to deflect at least some of flux of particles thus emitted across a substantially open spatial region through substantially 180 degrees of arc.

27. A method of providing charged particles of a preferentially selected mass-to-charge ratio, the method comprising the steps of:

applying a multipole mass filter to an influx of particles to provide a flux of charged particles of said preferentially selected mass-to-charge ratio, said flux having an average initial direction of propagation; and applying an electric field to said flux to deflect at least a portion of said flux through a substantially open spatial region substantially 180 degrees from said average initial direction of propagation to a new average direction of propagation.

28. A method of mass-filtering a particle flux comprising the steps of:

emitting a mass-selected subset of particles at one end of a multipole mass filter; and diverting at least some particles of said mass-selected subset of particles through at least one trajectory passing through a substantially open spatial region and comprising an arc of substantially 180 degrees.

29. The method of claim 28 additionally comprising the steps of:

providing a particle flux; and receiving said particle flux at an opposite end of said multipole mass filter.

30. The method of claim 28 additionally comprising the step of performing on said diverted particles an operation selected from the group consisting of collection, conversion, fragmentation, and detection.

31. The method of claim 28, wherein said emitting step comprises emitting said mass-selected subset of particles through a planar exit aperture disposed at said one end of said multipole mass filter, and further comprising the step of:

colliding at least some of said diverted particles with a target substantially in the plane of said exit aperture, to fragment said particles into fragments.

32. The method of claim 31, and further comprising the step of analyzing said fragments.

33. The method of claim 32 wherein said analyzing step comprises performing an analysis selected from the group consisting of mass analysis or energy analysis.

34. The method of claim 32 wherein said analyzing step comprises performing an analysis selected from the group consisting of time-of-flight analysis, magnetic sector analysis, mass filtering analysis, retarding potential analysis, or modulated retarding potential analysis.

35. A method of separating, from a source flux of particles, a subset flux of charged particles having a preferred mass-to-charge ratio, the method comprising the steps of:

filtering said source flux of particles with a multipole mass filter to provide a first set of particles comprising charged particles having said preferred mass-to-charge ratio and a second set of particles comprising other particles;

separating said second set of particles from said first set of particles by preferentially diverting at least a portion of said first set of particles through a trajectory passing through a substantially open spatial region and encompassing substantially 180 degrees of arc, to provide said subset flux of charged particles.

36. A method for retrofitting a mass spectrometer comprising the steps of:

removing an existing detector from said mass spectrometer; and operationally coupling the mass spectrometer with the existing detector thus removed to an electrode configuration for deflecting particles emitted at an exit .of said mass spectrometer through an arc of substantially 180 degrees traversing a substantially open spatial region.

37. A mass spectrometer comprising:

an elongated multipole mass filter element having an ion-optical axis;

a particle flux source coupled to said multipole mass filter element at a first end of said multipole mass filter element; and a configuration of electrodes comprising:

a substantially planar aperture electrode coupled to said multipole mass filter element at a second end of said multipole mass filter element, said aperture electrode having an aperture for passing particles emitted at said second end, said aperture electrode being disposed in a plane substantially perpendicular to said ion-optical axis;

a high-voltage plate electrode having at least one opening disposed above and substantially in the plane of said aperture electrode;

a grid disposed behind said aperture electrode; and a peripheral field electrode that, together with said aperture electrode, high-voltage plate electrode, and grid, defines and at least partly encloses a substantially empty chamber extending behind and above said second end.

38. The mass spectrometer of claim 37 further comprising a channeltron detector coupled to said high-voltage plate electrode.

39. The mass spectrometer of claim 37 further comprising a ledge separating said high-voltage plate electrode from said aperture electrode, said ledge being disposed in a plane substantially perpendicular to said plane of said aperture electrode.

40. The mass spectrometer of claim 37 wherein said aperture electrode is maintained at an electric potential of substantially 0 volts, said peripheral field electrode is maintained at a first electric potential, said first electric potential having a first polarity and a first absolute value, and said high-voltage plate electrode is maintained at a second electric potential, said second electric potential having a second polarity opposite to said first polarity and having an absolute value approximately at least five times greater than said first absolute value.

41. The mass spectrometer of claim 40 wherein said first polarity is positive and said second polarity is negative.

42. A mass spectrometer apparatus comprising:

a multipole mass filter emitting a flux of mass-selected charged particles;

a substantially planar exit aperture electrode held at a first electric potential through which at least a portion of said flux passes; and an attractive electrode that maintains a second electric potential over a substantially planar bounded surface located in a vicinity behind and above said exit aperture and substantially in the plane of said exit aperture, said second electric potential being an attractive potential with respect to charged particles of said flux.

43. The mass spectrometer apparatus of claim 42 further comprising a ledge situated between said exit aperture electrode and said attractive electrode, for electrically isolating said attractive potential from said multipole mass filter.

44. A mass spectrometer apparatus comprising:

a multipole field means for providing a combined radio frequency (RF) and direct current (DC) field for mass-selecting charged particles and emitting said mass-selected charged particles in an average direction at an exit aperture; and an ion-focusing electric field means having a range of focal points that preferentially selects a bounded range of mass-selected charged particle trajectories, each of said trajectories including a turn of approximately 180 degrees relative to said average direction of particles exiting said multipole field, said ion-focusing electric field means being operationally coupled to said exit aperture.

45. A mass spectrometer apparatus comprising:

a multipole field means for providing a combined radio frequency (RF) and direct current (DC) field for mass-selecting charged particles and emitting said mass-selected charged particles at a substantially planar exit aperture, said multipole field means having a longitudinal axis;

an electric field providing means for providing an electric field in the vicinity of a target disposed substantially in the plane of said exit aperture and offset from said exit aperture in a direction substantially perpendicular to said longitudinal axis, said electric field being attractive to said mass-selected particles; and shielding means for minimizing penetration of said electric field within said multipole field means.

46. A mass spectrometer apparatus comprising:

a multipole field means for providing a combined radio frequency (RF) and direct current (DC) field for mass-selecting charged particles and emitting said mass-selected charged particles at a substantially planar exit aperture, said multipole field means having a longitudinal axis;

an electric field providing means for providing an electric field in the vicinity of a target disposed substantially in the plane of said exit aperture and offset from said exit aperture in a direction substantially perpendicular to said longitudinal axis, said electric field being attractive to said mass-selected particles, wherein said exit aperture comprises a plate having a central cutout, said cutout having a shape tending to minimize penetration of said electric field within said multipole field means.

47. A mass spectrometry method comprising the steps of:

providing a source flux of particles;

using a multipole mass filter to mass-filter said source flux;

emitting into a substantially open chamber situated behind said multipole mass filter:

a subset flux of mass-selected ions having a bounded range of directions and focal points;

a cone of neutrals; and a cone of scattered ions; and using an electric field to preferentially capture and turn through an arc of substantially 180 degrees at least a portion of said subset flux while at the same time preferentially avoiding capture and turning of said neutral and scattered ion cones.

* * * * *

UNITED STATES PATENT AND TRADEMARK OFFICE

CERTIFICATE OF CORRECTION

PATENT NO. : 5,464,975

ISSUED : November 7, 1995

INVENTORS : Nicholas J. Kirchner and Michael Weber-Grabau

It is certified that errors appear in the above-identified patent and that said Letters Patent is hereby corrected as shown below:

Title page, item [76] Inventors: Nicholas J. Kirchner, Mountain View, Calif. 94040; Michael Weber-Grabau, Sunnyvale, Calif. 94087

Title page, item [73] Assignee:

--Assigned to: Massively Parallel Instruments, Inc., 2030 Fortune Drive, Suite A, San Jose, Calif.--

Signed and Sealed this

Ninth Day of July, 1996

*Attest:*

Bruce Lehman

BRUCE LEHMAN

*Attesting Officer*

*Commissioner of Patents and Trademarks*